US005740243A

United States Patent [19]

Rehm

[11] Patent Number: 5,740,243

[45] **Date of Patent: *Apr. 14, 1998**

[54] CRYPTOGRAPHIC GUESSING GAME

[76] Inventor: Peter Horst Rehm, 30 N. 700 East #4, Provo, Utah 84606

[ * ] Notice: The term of this patent shall not extend beyond the expiration date of Pat. No. 5,338,043.

[21] Appl. No.: 577,968

[22] Filed: Dec. 26, 1995

Related U.S. Application Data

[60] Continuation-in-part of Ser. No. 291,608, Aug. 16, 1994, Pat. No. 5,479,506, which is a division of Ser. No. 873,872, Apr. 21, 1992, Pat. No. 5,338,043, which is a continuation of Ser. No. 553,189, Jul. 13, 1990, abandoned, which is a division of Ser. No. 381,147, Jul. 13, 1989, abandoned.

[51] Int. Cl.[6] ..... H04K 1/00

[52] U.S. Cl. ..... 380/1; 380/28; 273/153 R; 273/272; 273/139

[58] Field of Search ..... 380/1, 28; 273/153 R, 273/272, 139

[56] References Cited

U.S. PATENT DOCUMENTS

| | | | |
|---|---|---|---|
| 3,117,789 | 1/1964 | Wiebe | 273/272 |
| 3,746,342 | 7/1973 | Fine | 273/272 |
| 3,891,218 | 6/1975 | Hilgartner et al. | 273/130 E |
| 4,185,833 | 1/1980 | McKee | 273/272 |
| 4,509,758 | 4/1985 | Cole | 273/240 |
| 4,687,201 | 8/1987 | Riviera | 273/153 R |
| 4,852,885 | 8/1989 | Baratpour et al. | 273/237 |
| 4,941,668 | 7/1990 | Mobrem | 273/272 X |
| 4,957,298 | 9/1990 | Silverman | 273/272 X |
| 5,297,800 | 3/1994 | Delany | 273/429 |

OTHER PUBLICATIONS

Jones, Nancy, *The Official Wheel of Fortune Puzzle Book*, 1987, pp. 10–199.

Desiderio, Elio, "Codeword," *Variety Puzzles and Games*, May 1988, pp. 8, 19, 35, 56 and 65.

"Cypher," *Superb Word Games*, May 1988, pp. 43, 63 and 65.

Shepherd, Walter, *Big Book of Mazes & Labyrinths*, pp. 22–23, 74–75, 106 and 110.

"Cryptograms," *Official Crossword Puzzles*, Dec. 1986, pp. 32–34 and 63.

Dell Publishing Co., Inc., "Have Fun With Cryptograms," 1948, pp. 1–2.

Hulme, Edward F., "Cryptography," London: Ward Lock and Co., 1898, Chapters 2 and 3.

Everett, Eric, "Crossword Cryptogram," 1932.

"Valiant A," 1985, pp. 112 and 115.

*Primary Examiner*—David C. Cain

*Attorney, Agent, or Firm*—Peter H. Rehm

[57] ABSTRACT

A method of playing a game that has a puzzle and a conforming device. The puzzle includes ciphertext indicia and a number of designated spaces corresponding with the ciphertext for displaying a developing solution. The ciphertext is a message encrypted according to some substitutional and/or transpositional encipherment scheme. At each stage of solving, the ciphertext and developing solution show what has been correctly solved and what remains to be solved. The conforming device verifies the correctness of correct guesses and corrects incorrect guesses without prejudicing future guesses. There are manifold types of messages, encipherment schemes, developing solutions and conforming devices. Some puzzles and conforming devices are made by a computerized method. The game can be played by one player or several players in competition. It can be played using a game board or other apparatus or by using a computer with an interactive computer program. To solve a puzzle, a puzzle solver first forms a guess-pair. Typically, a guess-pair is a plain character and a cipher character that could be the plain character's substitute. The conforming device is used to verify the correctness of the guess-pair, or if it is wrong, to obtain a correction. The verified or corrected guess-pair is then used to update the developing solution. These three steps are repeated at least once. There are various scoring rules for various versions of the game.

10 Claims, 23 Drawing Sheets

Microfiche Appendix Included
(1 Microfiche, 64 Pages)

FIG. 2
35
1. The music in my heart I bore, Long after it was heard no more. —William Wordsworth (The Solitary Reaper)
36
FIG. 3A
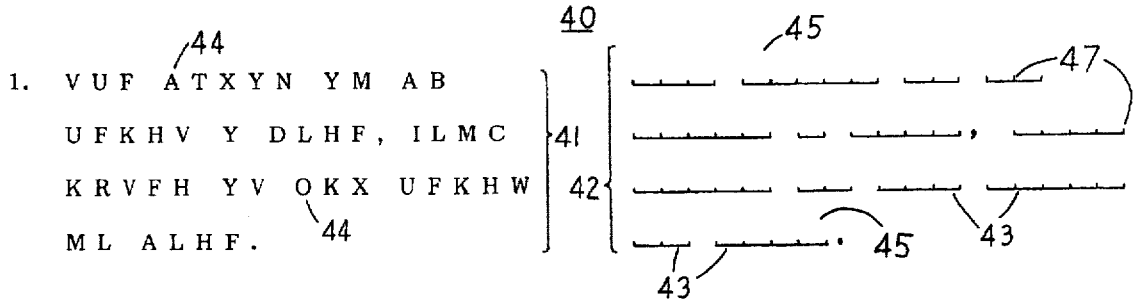
FIG. 3B
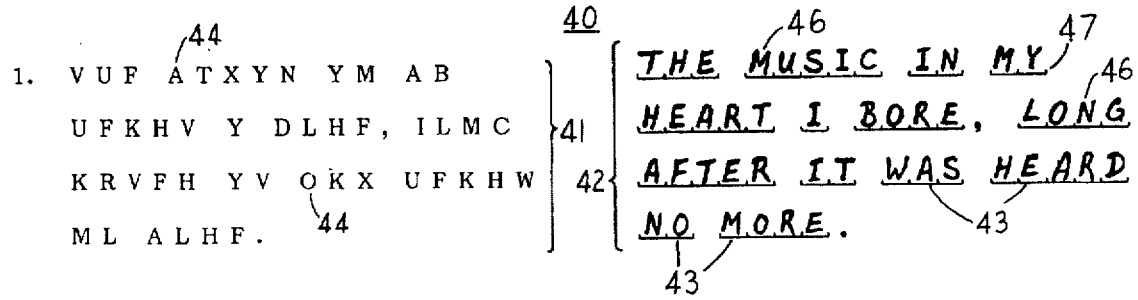

FIG. 4A 49 51 51 51 51 51 50

1. VUF ATXYN YM AB UFKHV Y DLHF, ILMC KRVFH YV OKX UFKHW ML ALHF.

FIG. 4B 49 52 51 52

1. VUF ATXYN YM AB UFAHV Y DLHF, ILMC ARVFH YV OAX UFAHW ML ALHF.

53 53 53

FIG. 4C 49 51

1. VUF ATXIN IM AB UFAHV I DLHF, ILMC ARVFH IV OAX UFAHW ML ALHF.

FIG. 4D 49 51 52

1. TUF ATXIN IM AB UFAHT I DLHF, ILMC ARTFH IT OAX UFAHW ML ALHF.

53

FIG. 4E 49 52 52

1. TUE ATXIN IM AB UEAHT I DLHE, ILMC ARTEH IT OAX UEAHW ML ALHE.

53

FIG. 4F 49 52 51

1. THE ATXIN IM AB HEAHT I DLHE, ILMC ARTEH IT OAX HEAHW ML ALHE.

FIG. 4G 49 52 52

1. THE MUSIN IN MY HEART I BORE, IONC AFTER IT WAS HEARD NO MORE.

FIG. 4H 49 52

1. THE MUSIC IN MY HEART I BORE, IONC AFTER IT WAS HEARD NO MORE.

FIG. 4I 49 51 52

1. THE MUSIC IN MY HEART I BORE, LONC AFTER IT WAS HEARD NO MORE.

53

FIG. 4J 49 52 52 52 52 52 54

1. THE MUSIC IN MY HEART I BORE, LONG AFTER IT WAS HEARD NO MORE.

53 53

FIG. 21A

250

253

1. V U F A T X Y N Y M A B U F K H V Y D L H F , I L M C K R V F H Y V O K X U F K H W M L A L H F . } 252

WILLIAM WORDSWORTH (PAR-3)

2. D G H N U E L G Y P Q E B L N I G P E Q E K U E J M G Y S Q D D A N U D D J U M L Y E B Q E K C G P Q B . } 252

WHATELY (PAR-1)

253

3. B Q D S Z E E D O B Q U B V G H R D V V B D U R V V Z G D B Q H F L P S Z G B Q D B Q H D P .

WILLIAM SHAKESPEARE (PAR-3)

4. N K R U Q L J Z A Y R Q M K R I , N Q O M K E J D Y P R R I R .

ANONYMOUS (PAR-5)

5. P N T S S N C N C P Y Q T Q I T H P Z P Q I C Y E K H S U T Q I .

POPE (PAR-3)

6. J F Z J V J Q N Q S J V R N Q G C Y H B F G C N J Q N G V S Q Y H B F G C S V N T Q H F .

PERSIAN SAYING (PAR-3)

255

258 265 259 257

| A # B | C # D | E # F | G # H | I # J | K # L | M # N | O # P | Q # R | S # T | U # V | W # X | Y # Z |
|---|---|---|---|---|---|---|---|---|---|---|---|---|
| K 1 D | N 1 W | F 1 R | C 1 U | Y 1 E | Z 1 I | A 1 M | L 1 Q | J 1 H | X 1 V | T 1 S | O 1 G | B 1 P |
| U 2 A | F 2 J | N 2 C | K 2 L | Q 2 Z | W 2 D | 1 2 E | G 2 T | R 2 P | H 2 B | Y 2 X | S 2 V | M 2 O |
| U 3 E | Y 3 O | D 3 P | L 3 Q | H 3 A | I 3 R | G 3 F | Z 3 X | T 3 S | V 3 B | C 3 N | M 3 K | J 3 W |
| Q 4 H | M 4 B | R 4 L | P 4 K | V 4 X | S 4 F | W 4 U | J 4 A | C 4 Y | I 4 Q | D 4 G | N 4 Z | E 4 T |
| P 5 J | L 5 Z | C 5 V | I 5 U | T 5 O | F 5 N | G 5 Q | E 5 R | A 5 Y | H 5 S | K 5 X | B 5 D | W 5 M |
| Q 6 A | E 6 C | F 6 Y | W 6 J | B 6 X | D 6 O | L 6 G | V 6 T | P 6 H | N 6 S | R 6 I | Z 6 U | M 6 K |

259 YOUR SCORE: (PAR-18 GAME) No. strokes ___; ___ under par, par, or ___ over par 257

270 261

FIG. 21B

250

253

1. THE MUSIC IN MY HEART I BORE LONG
VUF ATXYN YM AB UFKHV Y DLHF, ILMC
AFTER IT WAS HEARD NO MORE
KRVFH YV OKX UFKHW ML ALHF.

252

| A | I | N | O | S | T | E | H | R | F | W | D | M | Y | U | C |
|---|---|---|---|---|---|---|---|---|---|---|---|---|---|---|---|

WILLIAM WORDSWORTH
(PAR-3) BLG

253

2. LOSE AN HOUR IN THE MORNING AND YOU
DGHN UE LGYP QE BLN IGPEQEK UEJ MGY
WILL BE ALL DAY HUNTING FOR IT
SQDD AN UDD JUM LYEBQEK CGP QB.

252

| L | A | N | D | Y | I | O | U | W | G | T | E | H | | |
|---|---|---|---|---|---|---|---|---|---|---|---|---|---|---|

WHATELY
(PAR-1)

3. THE ROBBED THAT SMILES STEALS SOMETHING
BQD SZEEDO BQUB VGHRDV VBDURV VZGDBQHFL
FROM THE THIEF
PSZG BQD BQHDP.

| T | E | H | A | I | F | S | L | M | O | R | N | G | B | D |
|---|---|---|---|---|---|---|---|---|---|---|---|---|---|---|

WILLIAM SHAKESPEARE
(PAR-3)

4. WHEN A FOX PREACHES WATCH YOUR GEESE.
NKRU Q LJZ AYRQMKRI, NQOMK EJDY PRRIR.

252

| A | T | R | E | S | O | N | I | G | U | Y | W | H | C | P | M |
|---|---|---|---|---|---|---|---|---|---|---|---|---|---|---|---|

ANONYMOUS
(PAR-5) FX

5. A LITTLE LEARNING IS A DANGEROUS THING
P NTSSNC NCPYQTQI TH P ZPQICYEKH SUTQI.

| I | A | N | S | G | D | E | R | O | U | L | T | H | | |
|---|---|---|---|---|---|---|---|---|---|---|---|---|---|---|

POPE
(PAR-3)

6. HE WHO HAS A THOUSAND FRIENDS HAS NOT A
JF ZJV JQN Q SJVRNQGC YHBFGCN JQN GVS Q
FRIEND TO SPARE
YHBFGC SV NTQHF.

| A | T | O | N | S | H | E | W | U | D | L | R | P | F | |
|---|---|---|---|---|---|---|---|---|---|---|---|---|---|---|

PERSIAN SAYING
(PAR-3)

255

258 257 265 259

| A#B | C#D | E#F | G#H | I#J | K#L | M#N | O#P | Q#R | S#T | U#V | W#X | Y#Z |
|---|---|---|---|---|---|---|---|---|---|---|---|---|
| K 1 D | N 1 W | F 1 R | C 1 U | Y 1 E | Z 1 I | A 1 M | L 1 Q | J 1 H | X 1 V | T 1 S | O 1 G | B 1 P |
| U 2 A | F 2 J | N 2 C | K 2 L | Q 2 Z | W 2 D | I 2 E | G 2 T | R 2 P | H 2 B | Y 2 X | S 2 V | M 2 O |
| U 3 E | Y 3 O | D 3 P | L 3 Q | H 3 A | I 3 R | G 3 F | Z 3 X | T 3 S | V 3 B | C 3 N | M 3 K | J 3 W |
| O 4 H | M 4 B | R 4 L | P 4 K | V 4 X | S 4 F | W 4 U | J 4 A | C 4 Y | I 4 O | D 4 G | N 4 Z | E 4 T |
| P 5 J | L 5 Z | C 5 V | I 5 U | T 5 O | F 5 N | G 5 Q | E 5 R | A 5 Y | H 5 S | K 5 X | B 5 D | W 5 M |
| Q 6 A | E 6 C | F 6 Y | W 6 J | B 6 X | D 6 O | L 6 G | V 6 T | P 6 H | N 6 S | R 6 I | Z 6 U | M 6 K |

259 YOUR SCORE: (PAR-18 GAME) No. strokes 13; 5 under par, par, or ___ over par 261 270

CRYPTOGRAPHIC GUESSING GAME

This is a continuation-in-part of application Ser. No. 08/291,608, filed Aug. 16, 1994, now U.S. Pat. No. 5,479,506, which was a division of application Ser. No. 07/873,872, filed Apr. 21, 1992, now U.S. Pat. No. 5,338,043, which was a continuation of Ser. No. 07/553,189 filed Jul. 13, 1990, now abandoned, which was a division of Ser. No. 381,147, filed Jul. 13, 1989, now abandoned.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

A microfiche appendix consisting of 1 microfiche with 64 frames is a part of this specification. The microfiche appendix contains a computer routine.

BACKGROUND OF THE INVENTION

This invention relates to games, particularly to cryptographic puzzles and games in which one or more players decipher a ciphertext puzzle in a series of guesses.

Cryptogram puzzles as found in some periodicals are well known in the prior art. In these puzzles, quotations or other combinations of words which have been selected for their solvability, have each been enciphered with a transient simple substitution cipher. Every letter (plain character) has been consistently replaced by a cipher character, which is a symbol that represents or substitutes for the same letter wherever it occurs. The procedure for solving these puzzles involves searching the unintelligible ciphertext puzzle for clues such as word lengths, symbol occurrence counts, pattern words and multi-word repeating-character patterns, and others. These clues are used to form a series of educated guesses about what plain characters the cipher characters might represent. These guesses are written on the puzzle's trial solution area, one trial character wherever the corresponding cipher character appears. Eventually, this produces either sensible word fragments and more clues, or letter combinations that obviously are not part of any word in the language. The latter event indicates one or more trial characters are incorrect. Typically, several guesses must be written before any reliable judgement regarding the correctness of some of these guesses can be made, and certainty regarding early guesses lags behind still more guesses. Because these guesses are seldom all correct, solving cryptogram puzzles usually requires frequent erasures or writeovers of the trial solution area. Also, there is no guarantee the solution will ever be found.

While cryptograms are very popular, many people find them too difficult, including a significant number of fans of other kinds of word puzzles. Many potential cryptogram puzzle solvers either don't know where to begin, or they become frustrated when they get stuck. They are stuck when the available clues they know how to recognize fails to produce a correct guess within reasonable time and effort. It is customary in the prior art for the puzzle composer to supply a hint to help the solver get started. Such a hint typically reveals the plain character represented by one cipher character. Sometimes, rarely, one or two additional hints are provided. Also, sometimes hints are provided with the intent that they be used only if and when required, for example, when the puzzle solver notices he or she is stuck.

Such hints as are common in the prior art simply give away a portion of the solution. For every hint used, a proportionate amount of the challenge (and therefore sense of accomplishment) is taken away. Once the hints have been used, the puzzle solver is back to the trial and error method of solving using the trial solution area. The presence of such hints does not prevent the puzzle solver from becoming stuck. A puzzle solver can become stuck in spite of the hints the puzzle composer chose to provide. This can happen at the beginning or any time during the process of solving the puzzle. Also, hints such as those common in the prior art do not help the solver recognize when he or she is off track.

Several cryptographic games and apparatuses which involve the encoding or decoding of words are known in the art. In particular, U.S. Pat. No. 3,117,789 to Wiebe discloses a decoding game apparatus for two to four players. This game is played by each player solving a personal copy of a ciphertext puzzle by trial and error, using playing pieces bearing characters, instead of a writing utensil. Provided with each puzzle are three or so hidden hints or clues, one of which can be exposed whenever the players are stuck. Wiebe provides no method of selecting one hint over another according to its potential helpfulness or other characteristics. Scoring is accomplished by giving credit to the player who first correctly decodes a word, group of words, or the entire puzzle, with the possibility of penalties for mistakes.

U.S. Pat. No. 3,891,218 to Hilgartner et al discloses a crossword-type game named Zarton in which two players (or teams) use character-bearing playing pieces to form coded words in crossword fashion, and attempt to break each other's codes. The Zarton game has no trial solution area capable of receiving trial characters; instead, according to the rules of play taught by the patent, code breaking is accomplished by interrogation: A player asks whether a specific cipher character represents a particular plain character and waits for a reply. The same player may continue interrogating until he or she is wrong. If the player is able, he or she must then add a coded word to the crossword display. At the beginning of the game, each player reveals one plain character of his or her first coded word. This step is equivalent to the players giving each other one hint.

The Cryptographic Game Apparatus and Mode of Play of U.S. Pat. No. 4,509,758 to Cole discloses an apparatus for creating a random cipher and a method of play which includes one player using the apparatus to encipher a message. After the message is enciphered, a number of other players each make a personal copy of the newly-created ciphertext puzzle and have a limited time to decipher it. The players take turns audibly guessing at the cipher, to which guesses the first player responds with a "yes" or "no" answer.

The symbol puzzle disclosed by Riviera in U.S. Pat. No. 4,687,201 is basically a crossword puzzle provided with some spaces already containing characters and the remaining spaces containing fragments of characters. Every such character or fragment of a character is ambiguous in that it could represent either of two potential solution characters: Those that already are a character can be selectively left alone or by adding lines can be converted into at least one different character; and those that are a fragment of a character can be selectively converted into any one of at least two characters by adding lines. Although not a cipher, groups of these symbols have some characteristics of a cipher in that they hide the solution by making the puzzle look like ciphertext.

As can be seen from these inventions and the prevalence of cryptograms in some periodicals, cryptograms are a popular type of word puzzle. However, whatever the precise advantages, benefits, features, or attributes the above mentioned puzzles and games may have, none of them achieves or fulfills the purposes of the present invention as defined by the following objectives, disclosure, and claims.

OBJECTS AND SUMMARY OF THE INVENTION

Accordingly, it is an object of the present invention to provide a puzzle-like game that presents clues in ciphertext and has decoding options comparable to standard cryptogram puzzles, yet that guides the puzzle solver along one of many courses of action leading directly toward the solution. It is a further object to provide a puzzle game that is easy to learn and play, one in which skill in solving cryptograms is not necessary for the beginner to complete the puzzle but is developed while learning how to obtain a good score. It is a further object of the present invention to provide a cryptographic puzzle game in which erasures, writeovers, or replacement of trial characters on a trial solution is not a necessary part of the game. Another object is to provide a way to prevent propagation of an error made while playing such a game, should an error occur.

It is a still further object of the present invention to provide a new type of puzzle, which, from the puzzle composer's point of view, can be made from a wider variety of messages (quotations or other text) than is currently practical for standard cryptograms; a puzzle in which the message need not be carefully selected for solvability because any message, even one composed of difficult word combinations, is solvable.

It is a further object of the present invention to provide a cryptographic decoding game which has a new method of solving and a new mode of enjoyment, and which can be provided in a great variety of embodiments having altogether different characteristics.

It is a further object of the present invention to provide a new type of cryptographic guessing game in which the level of difficulty of each puzzle can be quantitatively estimated and clearly shown and for which compensation can be made when considering the solver's performance.

It is a further object of the present invention to provide a puzzle in which the solver does not become "stuck" and does not carry the burden of deciding whether to "give up" on a portion of the puzzle by seeking for a hint. It is a further object of the present invention to provide a puzzle in which the kind of "hints" that give away a portion of the challenge or sense of accomplishment are not used.

It is a further object of the present invention to provide devices for use with cryptograms by which a solver acting alone can conveniently obtain immediate feedback on a guess without inadvertently prejudicing future guesses.

Another object is to provide a cryptographic guessing game capable of incorporating complex encipherment schemes while still being solvable by the general word puzzle fan according to simple instructions provided with the game.

The present invention meets and fulfills the above mentioned objects by providing in new and innovative combination, a puzzle of ciphertext indicia, a display means for displaying a developing solution in conjunction with and corresponding with the ciphertext, and a conforming means to verify or correct guesses during deciphering. The ciphertext is made from a message enciphered according to an encipherment scheme. The message is hidden from the puzzle solver until he or she reveals it by solving the puzzle. The message can be a quotation, a group of related words, a word matrix similar to a crossword puzzle, or just about any other reasonable length of text.

The encipherment scheme can be substitutional or transpositional or a combination of the two. Substitutional encipherment schemes can be further classified into simple substitution ciphers and substitution ciphers with complexities. Some random scrambling in addition to the substitutions may also add complexities to the ciphertext.

The puzzle or display means comprises the ciphertext and the developing solution. The developing solution is characterized by the fact that, with some exceptions, it is updated only with solution characters that have been verified correct. The ciphertext and developing solution correspond to each other in one of at least three basic ways, or a derivative of these ways. These three ways are named interlinear, disjoint, and transforming. In an interlinear display the lines of ciphertext and the lines of the developing solution are arranged interlinearly, so each plain solution character is added to the display near its cipher substitute character. In a disjoint display, the ciphertext and developing solution are located in two separate sections, coordinated by relational indicia so the two parts correspond. In a transforming display, the plain characters of the developing solution cover or otherwise replace their cipher substitute characters as the latter are decoded.

The conforming means may be an indicial device, a physical apparatus, or an assistant having access to the cipher key may perform the conforming function. The conforming means enables a puzzle solver to obtain feedback on his or her guesses without perceiving something that would prejudice future guesses. The various types of conforming devices, apparatuses, and means include tabular devices with or without special characteristics, circuitous course devices, relative position devices, cards and card holders, removable-surface devices of various types, electronic devices, and assistants. The conforming means may be classified according to a variety of criteria.

The puzzles may be provided with difficulty ratings, attraction clues, an array of boxes in which to make a record of the guesses, and other helpful things. Several puzzles can form one game.

The puzzles are solved by forming a series of two-character guesses named guess-pairs. A guess-pair is a cipher character and a plain character that the puzzle solver believes are related in the cipher. The conforming means can either verify the correctness of a guess-pair or correct it by replacing one or both of the characters. After the guess is verified or corrected, it is named a conformed guess-pair (because the conforming means was referenced to make sure the guess is in conformity with the cipher). The conformed guess-pair is used to update the developing solution. Usually, this cycle is repeated until the whole puzzle is solved or until the incomplete parts are guessed in one outright guess. The principle of a sequence of conformed guesses leading to a complete solution also applies to a number of players competitively trying to solve a single puzzle.

The puzzles are made by obtaining and enciphering a puzzle message according to an enciphering scheme, printing the ciphertext so it corresponds to a developing solution, and printing or otherwise supplying a conforming means. Optionally, the messages may be analyzed in light of the enciphering scheme that is to be used to determine a difficulty rating. Also optionally, the messages may be rearranged or selected to create multi-puzzle games of uniform standard total difficulty.

Many other advantages, features, and additional objects of the present invention will become apparent to those skilled in the art upon making reference to the accompanying drawings and the following detailed description, in which is disclosed the principles of the present invention by way of illustrative examples of various preferred embodiments.

BRIEF DESCRIPTION OF THE DRAWINGS

FIG. 2 is a representation of the reference solution optionally provided with the game of FIG. 1A.

FIGS. 3A and 3B are representations of a disjoint display, which is another preferred embodiment of the display means of the present invention, shown before and after play of the game, respectively.

FIGS. 4A through 4J are representations of a transforming display, which is still another embodiment of the display means of the present invention, shown at various stages before, during, and after an example play of the game.

FIGS. 21A and 21B are representations of a multi-puzzle cryptographic guessing game according to the present invention, shown before and after the game is played, respectively.

DESCRIPTION OF THE PREFERRED EMBODIMENTS

Figure 1A:
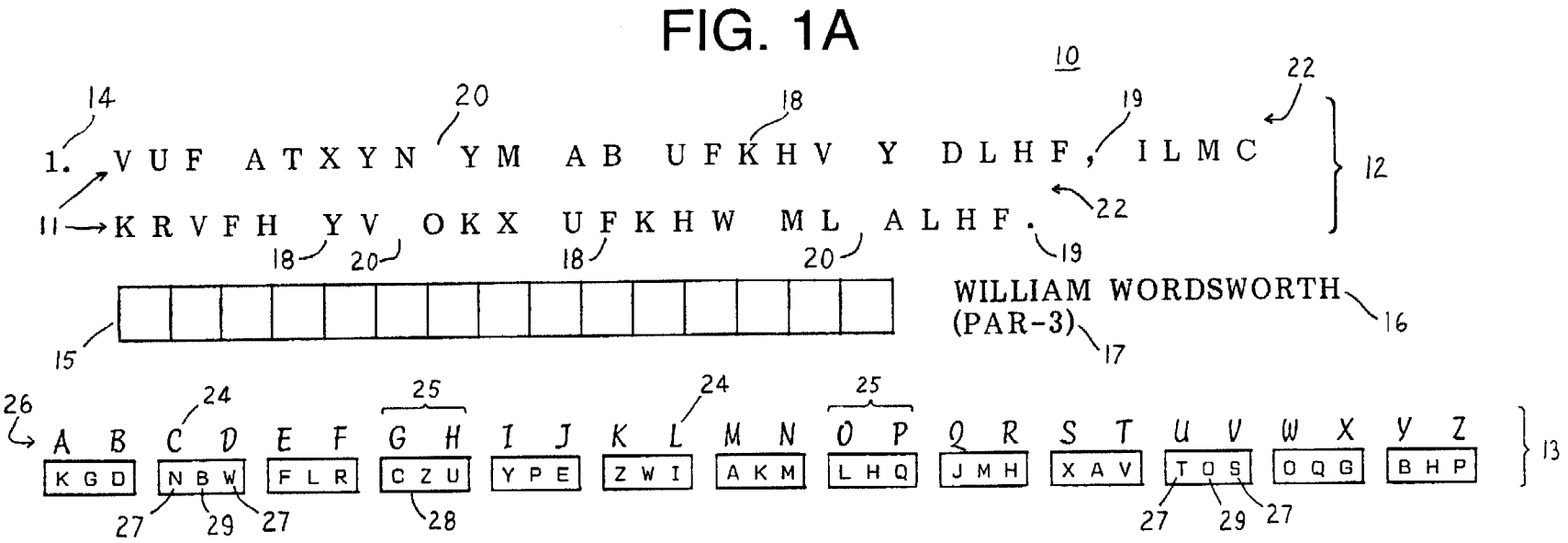
FIGS. 1A, 1B, 1C, and 1D are representations of an identical preferred embodiment of the present invention before, twice during, and after an example play of the game, respectively.

Reference is made to FIG. 1A wherein is depicted a preferred embodiment of a cryptographic guessing game incorporating both necessary and optional elements of the invention. The three necessary elements are ciphertext indicia 11, a developing solution 22, and a conforming device 13. The developing solution comprises plain characters 21 (see FIG. 1B) written by the puzzle solver and the space reserved to receive these plain characters 21. The space reserved to receive a particular plain character 21 is designated by the existence and position of a corresponding cipher character 18 according to certain rules. In this first example, the rule is that the designated place for a particular plain character 21 is just above its corresponding cipher character 18. The ciphertext 11 and its corresponding developing solution 22 must be in the puzzle solver's view, and will hereinafter be referred to collectively as the puzzle 12, the display means 12, or just the display 12, as the terms best fit the context. The conforming device 13, sometimes just called the device 13, is one type of conforming means that may be provided according to the invention. Every conforming device 13 or means must cooperate with the ciphertext 11 and the developing solution 22.

The optional elements include a puzzle number 14, an array of boxes 15 adapted to receive one or two characters each, an attraction clue 16 to attract potential puzzle solvers, and the puzzle's difficulty rating 17 in terms of the number of guesses expected to be incorrect.

A preferred embodiment like the one shown in FIG. 1A would normally be printed on some kind of substrate, such as paper or any other substrate that allows the display 12 to be updated periodically during solving. The invention could, however, be provided in a variety of ways and forms.

The ciphertext 11 is a message (not shown in FIG. 1) in an enciphered form. The message must not be apparent before the puzzle is solved, as its gradual discovery is the object of the game. This message can be a quotation, a group of names all belonging to some category, a common phrase or maxim, a crossword-type matrix, or even a single word if it contains enough repeated characters. The puzzle message can be any quotation or group of words. This is in contrast to conventional cryptogram puzzles, which can be unsolvable if the message is not carefully selected or altered to provide enough clues. Whenever an attribute of the message shows through the ciphertext, a clue is present. Thus, clues are attributes or patterns in the puzzle that reveal attributes or patterns in the message. Clues that are of use to this game fall into two categories: cipher-type clues, which are clues revealing patterns in the plain characters of the message, and non-cipher type clues. The invention works with both types of clues or either type alone, depending on the enciphering scheme.

The cipher-type clues includes the presence or absence of pattern words, and usually their pattern if any are present. Pattern words are words which have two or more occurrence of any one plain character. For example, the words "THAT", "ELSE", and "HIGH" are all pattern words with the same "1231" pattern. The cipher-type clues also include multi-word patterns such as the relative frequency of occurrence of the plain characters, repeatedly occurring pairs or triplets of characters, pairs of characters repeating in reverse, the location within words individual unknown plain characters tend to favor, and more clues based on the enciphering scheme. Also, all clues arising from an interaction between the ciphertext and the partially complete developing solution are cipher-type clues.

In contrast, non-cipher type clues usually include word lengths and punctuation, because spaces between words and punctuation symbols are usually unenciphered. Clues arising from the partially complete developing solution independent of the ciphertext are also non-cipher type clues. In the preferred embodiments of the invention, at least some of the cipher-type clues should be manifest. However, the invention is still useful if only non-cipher type clues are present. An example of ciphertext that provides no cipher-type clue is one in which no cipher character is used twice.

The ciphertext 11 is composed of cipher characters 18 and usually some punctuation symbols 19 and spaces 20. Unless otherwise stated, all ciphers are assumed to be substantially substitution ciphers. Transposition ciphers will be discussed later in a separate section. The substitution cipher characters 18 are characters chosen from any alphabet, mathematical symbols, etc., and randomly paired up with or assigned to the plain characters of the message to substitute for them in the ciphertext 11. In the given example, the cipher characters are themselves letters or characters of the same Roman alphabet. For completeness, characters of the plain alphabet which are not used in the message may still be assigned cipher substitutes so long as they are unique and therefore non-interfering.

This character by character assignment or pairing of cipher characters to the characters of the plain alphabet is collectively named the cipher. An individual assignment, namely a plain character and its cipher character substitute, is named a cipher-pair. Thus, a cipher pair is a pairing relationship. Note that one part of the cipher-pair comes from the cipher alphabet or ciphertext and the other part comes from the plain alphabet or plaintext. In spite of its name, a cipher-pair is never two cipher characters alone nor is it a pair of ciphers. In some encipherment schemes, two or more plain characters may be the plain part of a cipher-pair, and analogously, two or more cipher characters may be the cipher part of a cipher-pair, but the two parts of the pair are always one cipher part and one plain part. The cipher-pair gets its name from being a portion of the cipher, specifically, a single pair or assignment.

The cipher must usually be transient, meaning that every puzzle provided in accordance with the invention is enciphered with a different random cipher. The ciphers must be different enough to make it practically impossible for the puzzle solver to gain an undesired advantage from having solved previous puzzles. If ciphers are chosen from so a large a pool of ciphers that it is practically impossible for the puzzle solver to gain such an advantage, the above requirement is satisfied even though some ciphers may occasionally be repeated with another message.

The display 12 should be able to receive the plain characters 21 of the developing solution 22 one at a time in any scattered sequence without crowding the placement of future characters. The position of each cipher character designates a place for its plain character translation to facilitate quick and correct placement of the plain characters 21 and also to facilitate a visual correspondence between the ciphertext 11 and the blank or partly filled-in developing solution 22. Thus a place for every plain character 21 is simultaneously designated before the first guess is made, and the display 12 can be updated in an arbitrary sequence of guesses. It is for this reason the cipher characters 18 of the ciphertext 11 of FIG. 1A are spaced horizontally and vertically: to permit a plain character 21 to be written above every cipher character 18, or equivalently, below every cipher character 18 (the latter is not shown). The blank space thus created is reserved for the plain characters 21 of the developing solution 22. As the puzzle is being solved, the plain characters 21 that are written become part of the developing solution 22 in plaintext, which is arranged interlineally with the ciphertext 11 in this preferred embodiment. Other elements of the invention may also be in the puzzle solver's view but they will usually not be referred to as part of the display.

The last necessary element of game of FIG. 1A is the conforming device 13, a single table composed of thirteen boxed sub-tables 25. The purpose behind the boxed sub-tables 25 is partly design and partly function, as will be explained later. First, it is necessary to introduce guess-pairs and the need for conforming them.

One object of the cryptographic guessing game is to correctly guess as many of the cipher substitutions as possible. For the purposes of the present invention, each guess is called a guess-pair because it includes two parts: as with cipher-pairs, one part pertains to the plain characters 21 of the developing solution 22, and the other part pertains to the cipher characters 18 of the ciphertext 11. The guess-pair is a plain character and the cipher character the puzzle solver believes is the plain character's cipher substitute. The cipher character is usually chosen from the ciphertext 11. And the plain character is usually one the puzzle solver would like to see added to the developing solution 22. Both parts of a guess-pair are chosen by the puzzle solver. The plain part is named the plain guess character and the cipher part is named the cipher guess character. A guess-pair never consists of one or more plain characters without a cipher part, nor can a guess-pair consist of one or more cipher characters without a plain part.

A guess-pair is a guess in that the puzzle solver believes the two parts to correspond one with another, or, to put it another way, he or she believes the guess-pair equals or matches one of the cipher-pairs.

According to the invention, it is necessary to provide means to conform guess-pairs to cipher-pairs. One way to satisfy this requirement is to provide a conforming device. The device or other conforming means must cooperate with the ciphertext puzzle with which it is intended to be used. That means it must be based on the cipher originally used to encipher the message to create the ciphertext and not some other cipher. It should include most or all of the cipher-pairs needed in this enciphering step, and any cipher-pairs that were not needed in the enciphering step but that are included in the device should be non-interfering to the needed cipher-pairs so they cannot mislead the puzzle solver. A cipher-pair would mislead the puzzle solver if its proper use could result in an erroneous update of the developing solution.

Several functions of a conforming device or other conforming means make it useful to the present invention. One function is its ability to verify the correctness of a correct guess-pair without inadvertently revealing any cipher-pair other than the one which is equal to the guess-pair. Another function is its ability to reveal only one cipher-pair in response to a conforming means reference with an incorrect guess-pair. A third property or function provided by most preferred types of conforming means is the ability to select a cipher-pair to be revealed by one of its characters and reveal all characters of only that one selected cipher-pair, without inadvertently discovering all characters of any other cipher-pair. This property or function is called selectivity. The character used to select the cipher-pair is called the lookup character. A lookup character always comes from a guess-pair; it is a function for which either the plain guess character or the cipher guess character is used.

The function of the conforming device 13 in the game of FIG. 1A is based on relational positioning or proximity of the characters. Its selectivity is based on camouflaging indicia and the relative sizes of the two character fonts it incorporates. It is an example of a conforming means called a selective tabular conforming device. The top row of characters 26 (external to the rectangles 28) is in alphabetical order to facilitate their being used as selection characters 26 for the lookup characters. In this example, the selection characters 26 pertain to the plain characters 21 of the developing solution 22. The verification characters 27, which are each directly underneath a selection character 26, pertain to the cipher characters 18 of the cooperating puzzle 12. This means the table 13 is cipher-character correcting, because it is the cipher characters which are verification characters 27 to either verify or correct the guess-pair. The remaining characters, at the centers of the rectangles 28, are camouflage characters 29. Their function is to camouflage the neighboring verification characters 27. Other indicia, such as the vertical sides of the rectangles 28 assist in performing the same function. Without this camouflage indicia to effectively narrow the field of instantly perceptible vision, it would be harder to selectively reveal only a single cipher-pair. It should be pointed out that to unintentionally notice a second cipher-pair and thereby prejudice future guesses, it would be necessary to see and remember not only the two characters of the desired cipher-pair, but also two characters of an undesired cipher-pair, a total of four characters, and this in addition to the residual camouflaging effect of just having studied the ciphertext 11 and developing solution 22. Even if an extra cipher-pair is unintentionally perceived, it is quite possibly not a useful one because of the order in which cipher-pairs are arranged.

The array boxes 15 is designed for record keeping and to help prevent unnecessary mistakes. Each box is adapted to receive one or both characters of the puzzle solver's guess-pairs, plus an indication of which guess-pairs required correction. If such an array of boxes 15 is provided, the number of boxes should equal or approximate the number of unique cipher-pairs used to encipher the message to create the ciphertext 11. If equal, this number is conveniently made known to the puzzle solver. However, the actual number of guess-pairs it takes to solve the puzzle can vary widely, and it is not critical that every guess-pair be recorded in its own box. Neither is it critical to provide enough boxes. As a matter of design and utility, a uniform number such as 15 boxes is deemed adequate. In the example of FIGS. 1A–1D, only the plain guess character was recorded in the array of boxes 15. When the cipher guess character was corrected, its associated record character 31 was circled with a circle 32. The record created helps the puzzle solver see which characters have already been used in a guess-pair. Also, the conforming device 13 often shows the cipher-pairs in a confusion-causing manner, and examining the device can interfere with what the puzzle solver already knows. Therefore, having made a record of at least one character of the guess-pair helps prevent the guess-pair from being confused with the cipher-pairs of the table 13. It is especially useful to record the plain character of the guess-pair in the array of boxes 15, as this is the character that will again be written to update the developing solution 22. The boxes do not have to be square; any array of defined spaces not reserved for something else will do.

The plaintext attraction clue 16 attracts potential solvers to the game 10 by providing some interesting information about the message. In this example, the message is a quotation and the plaintext attraction clue 16 is the name of the author of the quotation.

The difficulty rating 17 of the ciphertext 11 is the average or par number of guess-pairs that are expected to be incorrect. This is a heuristic rating on the nature of the message, how many clues the enciphering scheme permits to come through in the ciphertext, and the anticipated skill of the typical puzzle solver. Alternately, the difficulty rating 17 could be the average number of corrections of selected puzzle solvers of known skill level who test-played the game.

If a difficulty rating 17 is provided, one object of the game is for the puzzle solver to choose guess-pairs carefully and accurately enough so that as few or fewer of them need to be corrected by the conforming means. The score can then be reported as being a certain number of corrections under par, on par, or a number of corrections over par. Alternatively, if no difficulty rating is provided, or if it is not numerically defined, the game may also be played in a non-competitive manner. The object then is just the satisfaction of forming correct guess-pairs and seeing them verified, completing the puzzle, practice, or just playing as a pass-time.

The Method of Play

Having described one preferred embodiment of the invention, it is now possible to disclose the method by which the ciphertext 11 is deciphered, using FIGS. 1A–1D as an example. The following should not be construed as representing the only way the example puzzle could be solved.

In overview, the method of solving the puzzle is a cyclic process with at least three major steps. In the first step of the cycle, the puzzle solver examines the clues showing in the ciphertext 11 and the corresponding developing solution 22 to form a guess-pair. The second step of the cycle is to conform that guess-pair so it is correct; that is, so it equals one of the cipher-pairs. It is now referred to as a conformed guess-pair, whether or not it required correction. The third step in the cycle is to update the display 12 with the conformed guess-pair. Usually, the three steps of the cycle are repeated until a terminating event occurs.

One important reason the conforming device 13 or other conforming means is referenced prior to updating the display 12 is to make sure the correctness of the plain characters 21 of the developing solution 22 can be counted on when forming future guess-pairs. A major difference between the trial solution of some prior art puzzles and the developing solution 22 of the present invention is that the developing solution 22 does not receive trial characters, but only verified solution characters 21 which do not change once they are added to the developing solution 22. Therefore, the developing solution 22 is updated or developed only by the addition of more characters, but never by removing a character. The puzzle solver should resist the temptation of putting test characters on the developing solution. However, if the puzzle solver can remember which characters are verified and which characters are tests, this distinctive feature of a developing solution is preserved. When an outright guess of the entire solution is made by a puzzle solver acting alone, he or she may write unverified characters on the developing solution 22, for reasons that will be explained later.

The conforming step converts the guess-pair to a conformed guess-pair, which may or may not be equal to the original guess-pair. It's called a conformed guess-pair because it has passed through the conforming step. This conforming is done by first determining which character of the guess-pair may be the lookup character. In this example, the table is cipher-character correcting, so the plain character must be the lookup character, and the other character will be referred to as the guess character. A record of the guess-pair may optionally be made in one of the boxes of the array of boxes 15. The next step is to locate the lookup characters among the selection characters 26 of the table 13, and when found, compare the verification character 27 directly underneath it with the guess character of the guess-pair. If the verification character 27 is the same as the cipher guess character, then the guess-pair is equal to one of the cipher-pairs and is therefore correct. Because it is correct, the conformed guess-pair is equal to the guess-pair, too. On the other hand, if the verification character 27 does not agree with the cipher guess character, then the guess-pair is incorrect. The verification character that was found in the tables replaces the incorrect cipher guess character of the guess-pair, resulting in a conformed guess-pair which differs from the original guess-pair. In this example of a preferred embodiment, a corrected conformed guess-pair is equal to the cipher-pair that has the plain character in common with the original guess-pair.

The fact that a guess-pair was incorrect may be recorded by making a tallying mark, such as drawing a circle 32 around the appropriate record character 31 in the array of boxes 15.

The display 12 is updated with the conformed guess-pair. This is done by searching the ciphertext 11 for occurrences of a cipher character 18 equal to the cipher character of the conformed guess-pair, and by writing on the display 12 a plain character 21 equal to the plain character of the conformed guess-pair at the place designated by each occurrence. Sometimes the cipher character of the conformed guess-pair will not be found even once in the ciphertext puzzle 11. In this event, verifying that it is not there satisfies the requirement to update the display. In the example of FIGS. 1A–1D, the designated place corresponding to each cipher character 18 of ciphertext 11 is just above cipher character 18 in question.

After the puzzle is solved, the number of corrections that took place is manifest in the number of circled letters. By counting and comparing this number with the par level of difficulty printed with the puzzle, the puzzle solver can get an idea of how well he or she did.

There are at least two kinds of terminating events. One terminating event is that the last remaining unknown cipher character 18 is translated into the correct plain character 21. Another terminating event which can occur after a plurality of guess/conform/update cycles have been completed is for the puzzle solver to attempt to guess the entire solution outright, even though a plurality of unique cipher characters 18 have not yet been decoded into their plain character 21 equivalents. If there are at least two unique undecoded cipher characters 18 in the ciphertext 11, this is called an outright guess. An outright guess is made by recording the proposed guess solution without individually looking up each guess-pair. In this case it is permissible to write an unverified character on the display 12, because according to the preferred method of playing the game the display 12 will no longer be used to form further guess-pairs. The checking of an outright guess and the scoring consequences will be explained later.

The invention is already being used without ever reaching one of these terminating events. The puzzle does not need to be solved for the invention to be rewarding and worthwhile playing. This is because two or more guess-conform-update cycles can use all of the features of the invention (other than the two terminating events). After the first guess-pair is either verified or corrected, as appropriate, and the developing solution updated, the developing solution contains new information that is known to be correct insofar as it is complete. A first or subsequent repetition of the guess-conform-update cycle has this information available for use in making a guess-pair. A short game is a game that lasts at least two guess-conform-update cycles but does not result in one of the terminating events described above. A short game can be complete in itself also because each guess/conform/update cycle is a separate challenge with a definite result of either success or failure to obtain a verification. A short game may be used either alone or as part of any other game. For example, it may be used alone by providing it in a newspaper. It may be used as part of another game to determine whether the puzzle solver has some opportunity in the other game, or the opportunity to play a short game can be a reward for performance in the other game.

An Example of the Method of Play

A puzzle solver commencing to play the game 10 shown in FIG. 1A might start looking for clues by examining the frequency with which various cipher characters 18 occur. In the ciphertext 11 of FIG. 1A it can readily be seen that there are six occurrences of cipher "F", five cipher "H"s, and four each of the cipher characters "V", "Y", "K", and "L" and various other cipher characters 18 which occur less frequently. In this method of encipherment, spaces 20 are true and all words show up as "cipher words", revealing many important clues such as word lengths, pattern words, which cipher character's position within the words, the existence of repeating cipher character patterns and other significant patterns involving cipher characters 18 that appear more than once. The puzzle solver may also observe that two very similar words are represented by cipher "UFKHV" and cipher "UFKHW". Also, the two words represented by cipher "DLHF" and "ALHF" differ in only one character in the ciphertext 11, and therefore, in the message too. It can also be seen that there is an absence of pattern words. The clues in the ciphertext 11 also reveal that the two-letter words cipher "YM" and cipher "YV" begin with the same character, and that there is a one-letter word, cipher "Y", which in the English language almost always represent a plain "A" or a plain "I". The ciphertext 11 at this stage of solving contains still more clues that an observant puzzle solver may know how to put to use.

The puzzle solver has various options open to him or her regarding how to use these clues. One is to use the frequency count together with a knowledge of typical frequency occurrence counts of letters in the English language. For example, to guess that the most frequently occurring cipher character is substituting for the most frequently used letter in the English language, a plain "E"; and that the second most frequently occurring cipher character is substituting for second most frequently used letter, a plain "T", and so on. Another line of reasoning usually open to the puzzle solver, but not so in this example, is to identify a pattern word which reveals a pattern that occurs in few English words and assume that it represents the most frequently used of these English words. A common example is that cipher pattern "1231" represents plaintext "THAT". Another strategy always available to the puzzle solver is to simply take a wild guess at any as yet unknown plain character and choose any cipher character to form a guess-pair. This creates new clues, usually at the expense of the score. If no score is kept, there is no penalty in being quick to make a wild guess.

In the ciphertext 11 of this example, an obvious clue is the one-letter word, cipher "Y", which is most likely either a plain "A" or a plain "I". For the purpose of further illustration, in this example I will have the puzzle solver choose for his or her first guess that he or she would like to see where the plain "A"s are, and that he or she believes them to be over the cipher "Y"s. Therefore, the puzzle solver's first guess-pair is A/Y (read as "A slash Y" or "A over Y").

The plain "A" is written in the left-most box of the array of boxes 15. Then, using plain "A" as the lookup character and referring to the conforming device 13, it is found that plain "A"'s corresponding verification character is a cipher "K" instead the expected cipher "Y", making the conformed guess-pair "A/K". The plain "A" in the box is marked with a circle 32 to note that the correction step took place. Then the interlinear display is updated by writing a plain "A" over every occurrence of cipher "K".

Figure 1B:
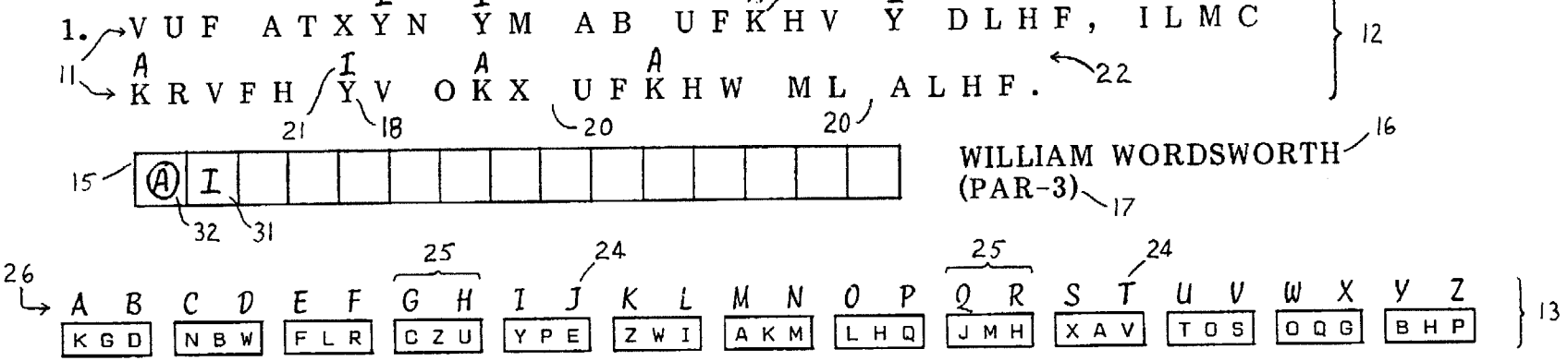

At this point, the ciphertext 11 and developing solution 22 together contain clues that the guess-pair "I/Y" would probably be correct. Using "I/Y" as the puzzle solver's second guess-pair, the plain "I" is written in the second box of the array of boxes 15 and looked up in the conforming device 13. The expected verification character, cipher "Y", is found in the table, indicating the second guess-pair is correct and the conformed guess-pair is also "I/Y". No circle is drawn in the array of boxes 15, only the plain character "I" is written over every occurrence of cipher "Y" in the ciphertext 11. It is at this point during the solving of the puzzle that FIG. 1B shows the state of the game 10. The developing solution 22 of the display is only partly complete, but those parts which are complete are correct. The fact that only correct information has been added to the developing solution 22 is an important feature of the invention.

FIG. 1B also shows how the ciphertext 11 and the developing solution 22 cooperate to create additional clues to enable the puzzle solver to evaluate the relative promise of the various possible guesses. It can be seen that the common character of the previously-mentioned two-letter words, cipher "YM" and "YV", is a plain "I". These words most likely represent two of the following four English language words: plain "IF", "IN", "IS", or "IT". Other words or abbreviations are possible, but occur much less frequently in the English language. If the puzzle solver notices this fact he or she has opened up the option of choosing an educated guess from among these four possibilities, an improvement over a completely wild guess. However, the ciphertext 11 and developing solution 22 contain clues that can improve the odds even more. The cipher "V" is used more frequently than the cipher "M", four times compared to three times. This suggests cipher "V" might represent plain "T", because in the English language "T" is known to be the most frequently used letter out of the four possibilities previously presented. Moreover, a supporting clue is in the fact that the cipher "V" also occurs at the beginning of a three letter word. The English language word "THE" is one of the most common words in the language, and it often occurs at the beginning of sentences. Therefore, FIG. 1B contains clues favoring the guess-pair "T/V" as having a particularly good likelihood of being correct. Referencing the conforming device 13 verifies that "T/V" is in fact a cipher-pair.

Figure 1C:
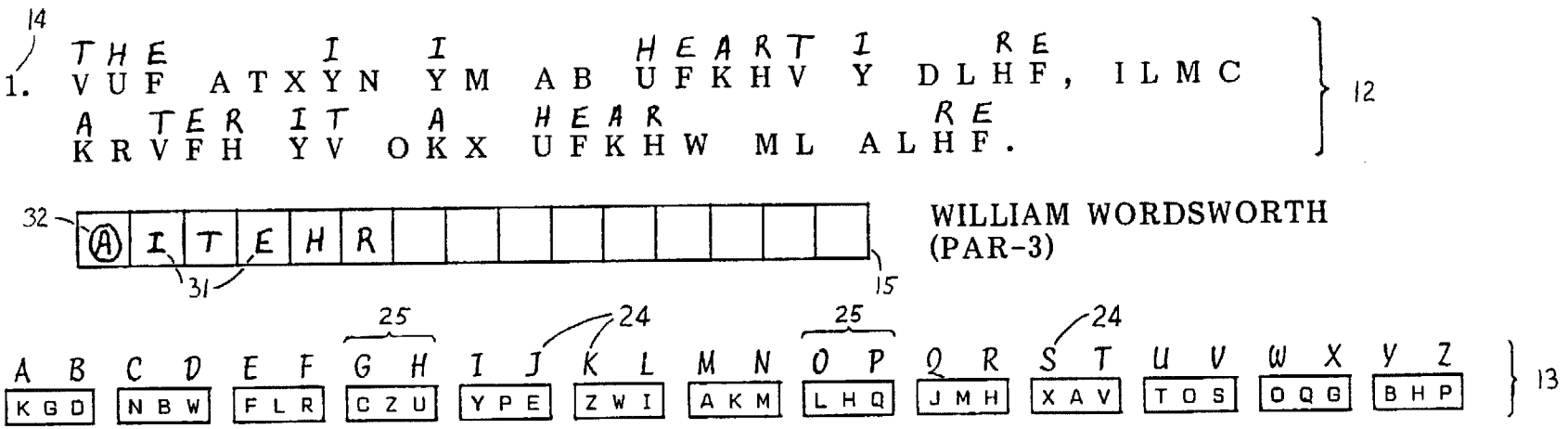

FIG. 1C shows the game 10 at one possible later stage of solving. The display 12 presents a variety of clues suggesting good potential guesses. The cipher word "KRVFH" could be "AFTER" or "ALTER". The cipher word "UFKHW" could be "HEARD" or "HEARS", but not "HEART" because the plain "T" is known not to be cipher "W". The likely possibilities for cipher word "YM" have been narrowed down to plain "IF", "IN", or "IS". Guesses based on the above possibilities could be made haphazardly with a reasonably acceptable effect on the score. However, the combination of the ciphertext 11, the developing solution 22, and the fact that the conforming device 13 assures that all characters in the developing solution 22 are correct, make it possible for a puzzle solver to be more accurate than this.

Using the cipher word "YM" as an example, rather than just picking a wild guess from among the plain words "IF", "IN", and "IS", the puzzle solver may try to guess the cipher "M" based on clues that require a greater level of skill to find and use. For example, the cipher "M" also occurs at the beginning of the cipher word "ML". This means the message probably has a two-letter word beginning with plain "F", "N", or "S". If the puzzle solver knows and realizes that there is no two-letter word beginning with the letter "F" in the English language, he can essentially rule out the guess-pair "F/M", thus narrowing it down to two possibilities. The only other cipher "M" occurring in the ciphertext does not yet have enough deciphered characters nearby to provide enough clues to help distinguish between the remaining likely possibilities for cipher "M", namely plain "S" and plain "N". If the puzzle solver does not see any better clues he has the option of taking a guess between the two remaining most-likely guess-pairs, or he or she may abandon the cipher "M" and look elsewhere for a new angle. However, the ciphertext contains still more clues incorporating the cipher "M", which are available to the puzzle solver according to his or her knowledge and diligence.

If the puzzle solver knows and realizes that the only English language two-letter word beginning with "S" is "SO" and that the only non-rare English language two-letter-word beginning with "N" is "NO", a more certain guess-pair arises, which is "O/L". Looking up the guess-pair "O/L" first is good strategy because it will likely lead to the creation of more clues to help with the cipher "M" later on. The interrelationship between the ciphertext 11 and the developing solution 22 therefore makes it possible for the careful puzzle solver to be relatively certain of where particular plain characters appear, and upon conforming and updating, use this information to clear up ambiguities about where other plain characters appear, thus improving the accuracy of both present and future guesses. The display 12 can provide such certain clues because the conformed guess-pairs which are used to update it are guaranteed to be correct.

Since any sequences of guesses, even alphabetically ordered guesses, would eventually reach the desired solution, it can be said that another goal or challenge for the puzzle solver is to find an optimum sequence of guesses, one that leads to the solution with the fewest number of corrections.

Figure 1D:
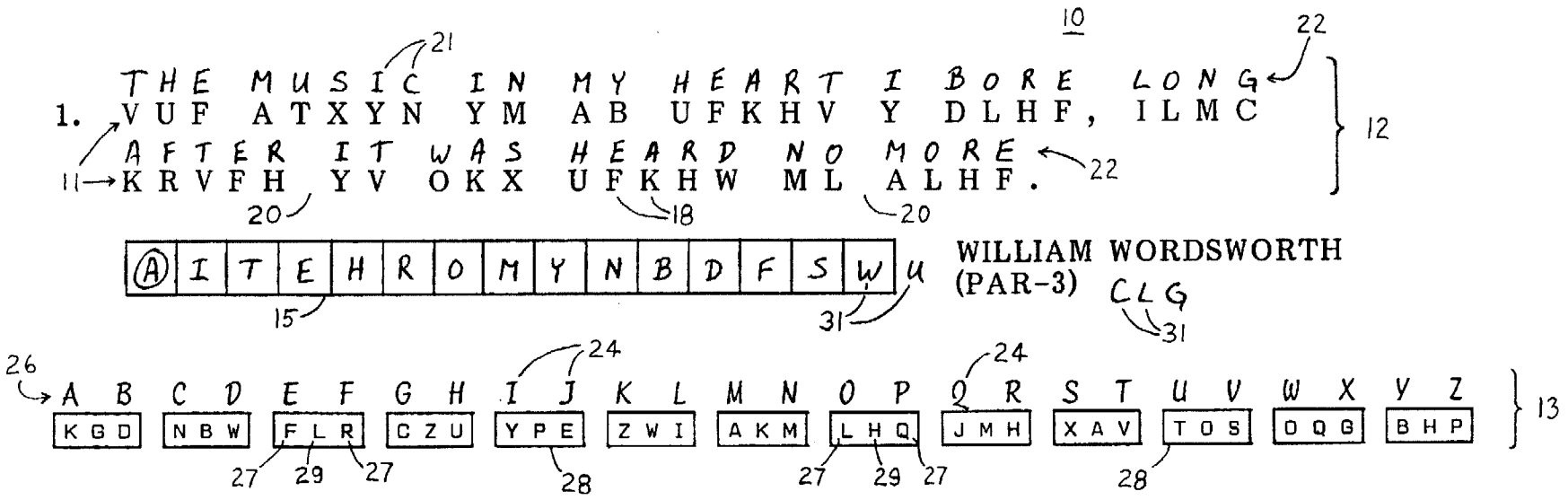

FIG. 1D is the game 10 of FIG. 1A after play is complete, with the developing solution 22 completely filled in and the record characters 31 showing the sequence of lookups and their outcomes. This is only one of many possible sequences that would have solved the puzzle. When there are more unique cipher-pairs used in the game 10 than there are boxes available, the puzzle solver may continue his or her record by writing record characters 31 beyond the array of boxes 15, as was done in this example.

Even if the puzzle solver cannot find a good guess, making wild guesses can hurt only the score, if score is kept, not the possibility of eventually finding the solution. The puzzle solver is never stuck; almost all guesses, whether correct or incorrect, move the developing solution closer to the final solution. The only exception is when a conforming means reference shows that a plain character does not occur in the puzzle at all. This relatively uncommon event, which can happen only when doing a cipher-correcting conforming means reference, nevertheless reveals this useful fact about the puzzle. When it is necessary to make a wild guess, it is worthwhile to make the two guess characters as reasonable as possible. Since even a "wild" guess-pair has two parts there is always a chance it equals a cipher-pair. On the other hand, if a correction of the guess-pair is highly likely, the relative expected usefulness of the resulting conformed guess-pair for one lookup character or another can be given greater consideration.

Therefore, it can readily be seen that the present invention does not require the puzzle solver to risk propagating errors by incorporating unverified guesses into a tentative or trial solution. Neither does it limit the puzzle solver to a yes or no response for his or her guesses. Nor does it give away an unearned or unpaid for portion of the solution through preselected or randomly dispensed hints. Nor does it require the puzzle solver to detect when he or she is stuck and admit this by "giving up" to get help. The present invention does automatically either verify or correct guesses to provide help only when needed, and usually exactly where needed. Each guess-pair, therefore, is both a guess to be verified and a strategic request for help. The optimum balance between these two strategies depends a great deal on the relative confidence with which each guess-pair is formed, and is a source of enjoyment and fulfillment provided by the new type of puzzle game of the present invention.

FIG. 2 shows the printed solution 35 optionally provided with the puzzle game. It enables the puzzle solver to double check the characters which were individually transcribed for clerical errors. It would, of course, have to be provided in a way that the puzzle solver could easily keep it hidden until his or her efforts to solve the puzzle are complete. For example, it could be printed upside down on the same page as the rest of the game, on another page of a periodical, in the next issue of a newspaper, etc. The printed solution 35 can also contain additional information 36 about where the puzzle came from or other interesting facts, in this example, the title of the work from which the message was taken.

The printed solution 35 also enables a puzzle solver to more conveniently check the correctness of an outright guess. For scoring, every unique mismatch should be counted as a separate conforming correction, as if guess-pairs were looked up individually. Thus by making an outright guess the puzzle solver implicitly forms two or more guess-pairs without the benefit of the clues these guess-pairs could produce for each other if they were looked up individually. Of course, the puzzle solver who believes he or she can correctly guess the whole solution always has the option of continuing to look up and verify each guess-pair individually until the entire puzzle is solved. If the proposed outright solution would have been correct, the latter option of individually verifying each remaining guess-pair cannot result in a poorer score.

The number of lookup operations or conforming references could be limited and the limit varied from one puzzle to the next according to the puzzles' difficulty. One convenient way of expressing this limit is by providing only the number of boxes specified by the limit for each puzzle and requiring the puzzle solver to refrain from exceeding this limit.

The game may be played by a number of puzzle solvers or players in competition with one another. With one such apparatus and mode of play, a common copy of the display 12, which comprises the ciphertext 11 and the developing solution 22, is provided and placed in view of all players, but most types of conforming devices should not be in view of the players. Rather, they should be referenced through an impartial player who is not a puzzle solver. If such a player is not available, then one of the puzzle solvers could be trusted to not intentionally study the conforming device, or one of the safest conforming devices hereinafter disclosed could be used in view of the players. The safest conforming devices make it impossible for a player to cheat without leaving a trace. Any cipher-key, even without circuitousness, would be suitable if it is referenced only through an impartial player.

It will be appreciated that the particular embodiments and rules of such a multi-player game could vary greatly within the spirit and scope of the invention. Merely as an example, the puzzle solvers may take turns forming guess-pairs to solve the puzzle. After a puzzle solver announces his or her guess-pair, the guess-pair is conformed and the display is updated by or under the direction of the impartial player. If a player's guess-pair was correct, the play continues with that same player taking another turn. Rather than counting corrections, the penalty for an incorrect guess-pair is the loss of the turn to the next player. The players could accumulate points or potential rewards for each correct guess-pair. The player to correctly complete the developing solution would be designated the winner and receive his or her accumulated potential reward.

The player accessing the conforming device may also keep score by tallying how many correct guess-pairs or points or potential rewards each player has accumulated. One goal of the game is to accumulate the greatest number of points or the largest potential reward. Another goal is to be the solver of the puzzle and thereby designated winner of the game by correctly guessing the last remaining unknown cipher character. These goals could be accomplished one guess-pair at a time, or for any turn in which the puzzle solver is sufficiently confident, by an outright guess of the entire message. A puzzle solver correctly guessing the whole solution is given credit for every remaining unknown cipher-pair as if they were guessed one at a time. In a multi-player game an outright guess may be made audibly, leaving the display unchanged in the event it is incorrect, and permitting play to continue with the next player.

A particularly interesting method of accumulating potential rewards is for each player to double the size of his or her potential reward with each correct guess-pair. Of course, some means of providing an initial potential reward has to be provided. One way is to start every player off with the same small initial amount by making a correct guess-pair or something. This method of accumulating automatically puts a ceiling on how great the potential reward can become, which ceiling is a function of the number of unique cipher-pairs present in the puzzle. For example, a puzzle with fifteen unique cipher-pairs, using a common initial grant of one point, has a ceiling of 32,768 points. The ceiling can be reached only if one player solves the puzzle alone without a single error. It is the nature of the game for the players to miss at least a few guess-pairs and get the majority right. How many they typically miss can be controlled through the selection of the ciphertext according to the difficulty rating. An alternative method of doubling is to assign each guess a value of $2^{n-1}$ points, where n is the guess number, regardless of the history of solving.

The cryptographic guessing game can also be implemented in an interactive computer version. In this embodiment the computer obtains a puzzle from a pool of puzzles, enciphers it, and displays it along with a place for a developing solution on an output means, such as a printer or video screen. The puzzle solver enters his or her guess-pairs through a keyboard, mouse, or other input means. The computer then conforms the guess-pair, informs the puzzle solver whether or not the guess-pair was correct, and updates the developing solution. It also keeps track of how many guess-pairs required conforming. To make the game more exciting, it can set and enforce time limits, either on a guess-pair by guess-pair basis or one time limit for an entire puzzle. It can compare the puzzle solver's performance to that of a fixed standard such as the par, and can give evaluations of how well the puzzle solver did.

Where possible, the interactive computer version should be made more exciting by using the audio capabilities of the computer. If the computer can only make some sounds such as various tones, certain tones should be sounded whenever certain events occur. Some examples of these events include the presentation of a new unsolved puzzle, a correct guess-pair, an incorrect guess-pair, an incorrect outright guess, and the completion of the developing solution. If the computer has audio multimedia capabilities including the ability to play waveform sound files, these and other events can be explained by a voice stored in a waveform file. Upon correction of a guess-pair, the voice can announce the cipher-pair that was selected to replace the guess-pair. The voice can announce the score of one or several players as the game progresses. Of course, the puzzle solvers should be able to turn off the voice or sounds if they prefer silence.

In a more sophisticated implementation of the invention, when the computer presents a new puzzle, the voice can introduce it by pointing out some patterns or features in the ciphertext. The introduction can be accompanied by temporarily highlighting each pattern or feature as it is introduced. The user should be able to turn off these introductions at will. They are intended to help new players develop skill in the game. Some features the computer might detect and point out include the top three or so most frequently occurring cipher characters, identical cipher characters that are next to each other, patterns of three or more cipher characters that occur more than once, and so on. Implementing this does not require a computer that can speak English. It will be sufficient for the computer to have access to waveforms for the letters of the alphabet, numbers for scores, and certain phrases. These segments may be pieced together to say things such as "the cipher letter" "V" "appears" "four" "times in the puzzle" and "player one has," "one thousand twenty fours," "points." If the method of scoring is the first-disclosed doubling method, then all scores will be a power of two. This helps limit the number of voice segments needed for numbers.

To make an outright guess on a computer interactive game for one or more players, a player should first notify the computer of his or her intent to make such a guess. Then the outright guess may be entered in a separate dialog box. If the outright guess is incorrect, the computer can close the dialog box and permit play to continue with the next player. Alternatively, the computer could have the player enter the outright guess directly on the developing solution. If the outright guess is incorrect, the computer can restore the developing solution to its pre-guess state and continue with the next player. Either method will work with the invention, but the dialog box approach is more purely in harmony with the invention and is preferred. The danger with the other approach, typing the outright guess directly on the developing solution, is that the ciphertext is present. The player might study how the partly entered outright guess looks with the ciphertext before returning control to the computer. This would turn the opportunity of making an outright guess into a way to enter and study trial characters on the developing solution.

Another embodiment of an interactive computer version can be implemented for use with a home video game computer system. It would simply be ROM cartridge containing the necessary software and a number of messages plus the hardware and software necessary for any such ROM cartridge to be compatible with the system.

I will now disclose other preferred embodiments of elements of the invention. These can be used to create cryptographic guessing games with other types of display means, other kinds of conforming means, and/or other types of ciphertext. The ciphertext can be made from different kinds of messages and/or the message can be encrypted according to other kinds of encipherment schemes.

The Display Means

The display means (or just the display) comprises the ciphertext and the developing solution, two elements of the invention which must be in the puzzle solver's view. These two elements must correspond to each other so they can be used together, but this can be done several ways, and the resolution with which they correspond is a matter of degree. For them to correspond character by character is preferred but not absolutely necessary, for in some puzzles word-by-word is sufficient. There might even be some very small puzzles, such as one or two words, in which it is obvious how a developing solution on any blank sheet of paper would correspond. The important thing is that the ciphertext and perhaps other assistants such as guiding indicia automatically reserve the right amount of space for all characters intended to become part of the developing solution. This is to enable the puzzle solver to quickly find a place to put plain characters without being concerned about reserving space for future plain characters or words. If the puzzle solver immediately knows where to put the plain characters of the developing solution without crowding future guesses, for any sequence of guesses, then the ciphertext has a corresponding developing solution. This means that the display's designated places for the plain characters of the developing solution are simultaneously designated.

The type of display shown in FIG. 1A through 1D is called an interlinear display 12. This type of display is so named because the places designated to receive the plain characters 21 of the developing solution 22 form one or more lines that are arranged interlineally with respect to the lines of ciphertext 11. This type of display is characterized by the fact that every cipher character 18 designates a place nearby to receive the plain translation of that cipher character, specifically, the designated place for every plain character 21 is closer to it's cipher substitute 18 than any other plain character's 21 cipher substitute 18.

Other types of alterable displays are also possible. One of these is shown in FIGS. 3A and 3B. This type is called a disjoint display 40 because the developing solution 42 of the display 40 and the ciphertext 41 are two separate sections, divisible by a straight line. An additional characteristic is that cipher characters 44 and the places designated 44 for their plain solution characters 46 are not related by their proximity; in other words, a particular designated place may be closer to an unrelated cipher character than to its related cipher character. The puzzle solver knows where to write each plain character 46 by the spacial similarities between the guiding indicia 43 on the developing solution section 42 and the ciphertext section 41 of the display.

The preferred embodiment of FIG. 3A and 3B shows the guiding indicia 43 of the developing solution section 42 with a distinctly designated place 45 for every character of every word because of the vertical notches 47. For some particularly spatially oriented puzzle solvers, less guiding indicia 43 may be sufficient, such as just a single horizontal line for each word, with each line's length being proportional to the number of character in the word for which it is designating a place. Another alternative technique for correlating words of the developing solution section 42 and the ciphertext section 41 so they correspond is to key them with identifying indicia such as word numbers, or character numbers, thus eliminating the need for spatial similarity.

FIGS. 4A through 4J show selected schematics of a third type of alterable display called a transforming display 49. In this type of display 49, as the cipher characters 51 of the ciphertext 50 are decoded, they are individually replaced by the plain characters 52 for which they substitute. Thus the ciphertext 50 gradually gives way to the developing solution, as it gradually transforms into plaintext, in any random sequence. FIGS. 4A through 4J show the same transforming display 49 at ten selected stages of transformation during the solving of the puzzle.

FIGS. 4A–4J are schematic representations of a transforming display 49 apart from any substrate or projection means. For purposes of comparison, the same guess-pair sequence shown in the array of boxes in FIG. 1D is used. FIG. 4A shows the puzzle on the transforming display 49 before any guesses were made. This is the only time a transforming display shows pure ciphertext 50. FIGS. 4B–4F each show the same puzzle on the same transforming display 49 after the first five guess-pairs, "A/Y", "I/Y", "T/V", "E/F", and "H/U", respectively, were made. The line of text is now a mixture of cipher character 51 and plain characters 52, the latter being indicated by underscores 53. The developing solution comprises the plain characters 52 on the display and the places designated for more plain characters which are occupied by cipher characters, but it does not include the cipher characters themselves. Note in particular how the incorrect guess-pair "A/Y" resulted in the cipher "K"s being transformed into plain "A"s. The results of the ten guess-pairs "R/H" through "W/O", inclusive, are not shown. FIGS. 4G through 4J show the remaining ciphertext and developing solution after the guess-pairs "U/T", "C/N", "L/T", and "G/C", respectively. FIG. 4J shows the completed developing solution 54 after the last guess has been made. Every character has been transformed from a cipher character 51 to a plain character 52. The disappearance of the cipher characters 51 when they are decoded is acceptable because they become redundant and unnecessary.

In the schematics of FIGS. 4A–4J the cipher characters 51 can be distinguished from the plain characters 52 because the latter have underscores 53. For example, FIG. 4C has both plain A's and cipher A's. This is one way to distinguish them, but it is equally effective to use different fonts for the cipher and plain character sets, that is, two character sets that differ in style or size or both, or to use a cipher character set chosen from a different alphabet so no two characters are alike, or to use different colors for the characters or their backgrounds, etc. However, it is still possible to play the game, and it even adds element of skill or challenge, if like plain and cipher characters appear indistinguishable. This requires that some external means such as a computer or an assistant keep track of which is which to update the display correctly. All guess-pairs would still be useful if they are new, but in order to score well, the puzzle solver has the added challenge of having to remember which characters are plain and which are cipher.

A transforming display 49 can be used on a computer output device such as a printer or monitor, updated by the computer as the puzzle solver inputs his or her guess-pairs. Alternatively, it can be implemented as a board game with a set of character-bearing playing pieces such as tiles. The ciphertext with cipher characters can be printed on a sheet (the board) with the cipher characters so spaced that the tiles can cover them, one tile per cipher character, without crowding. As the puzzle is being decoded, the plain character tiles are placed directly on top of the cipher characters. Alternatively, more tiles could be provided to also spell out the ciphertext. Then the developing solution would be updated by exchanging or stacking tiles.

The Conforming Means

The tables 13 of FIG. 1A–1D are only one example of a conforming device. A myriad of other kinds, types, and styles can also be used to perform the same function, though the various types may have some individual characteristics, unique properties, and even peculiar advantages and disadvantages. Usually, the conforming devices are to be in the puzzle solver's view to be used by him or her, but under some circumstances they should be referenced through an assistant.

All conforming devices or means must convert a guess-pair into a conformed guess-pair, the latter always being equal to a cipher-pair. If the guess-pair is correct (already equal to a cipher-pair), then the guess-pair becomes the conformed guess-pair without being changed. The conforming device should be usable without revealing more than one cipher-pair per reference. If the guess-pair is correct, its verification counts as the one cipher-pair revealed, but if it is incorrect, some cipher-pair must be chosen to be revealed. One important way the various embodiments differ is in how this cipher-pair is chosen.

The conforming devices or means, and the methods of using them, fall into four classes. The first is cipher-character correcting, the type disclosed in FIGS. 1A–1D. Second is its opposite, plain-character correcting. Third is bidirectional, a combination of the first two that allows the puzzle solver to choose on a guess by guess basis which character of each guess-pair he or she wants to be the lookup character and which should be the "guess character" subject to correction. The fourth is dual-correcting, a type of device that changes both characters of an incorrect guess-pair to form an unrelated conformed guess-pair. Some puzzle solvers may prefer surprise over logic in obtaining help for incorrect guess-pairs. Dual-correcting conforming means can be further classified according to how the conformed cipher-pair is chosen, whether by random chance or by each cipher-pair's likelihood of being useful to the puzzle solver, or whether they are selected only from among cipher-pairs that were used in enciphering the message and that have not yet been revealed during the game.

Generally, for a conforming device of the first three classes to be useful, it should allow a solver to easily find his or her lookup character among the device's selection characters and discover only this character's cipher code partner, which is called the verification character. Just as selectivity in a radio receiver is the degree to which it will reproduce the signals of a given transmitter while rejecting the signals of others, this property of a conforming device made in accordance with the invention to assist the puzzle solver in his or her efforts not to notice other cipher-pairs, is also called selectivity. The selectivity of a conforming device or means may be based upon one or more techniques or principles: camouflaging indicia, a circuitous network of defined courses to follow, scrambled positioning of characters, selectively removable covers, the assistance of another player or a machine, and other techniques. Selectivity in most of these devices is also a matter of degree, and for some types of devices it is influenced by the puzzle solver's visual acuity or training.

To further illustrate the concept of selectivity, as applied to these devices, note that the selectivity of tabular devices of the type shown in FIG. 1A can be increased in one or more of the following ways: (1) increasing the distance between verification characters 27; (2) placing camouflaging indicia such as camouflaging characters 29, puzzle numbers, or lines, between or around verification characters 27; (3) using small or otherwise hard to read verification characters 27; or (4) non-alphabetical placement of selection characters 24, especially if newly scrambled from one device 13 to the next. The latter technique (not shown in FIG. 1A) makes it harder for a puzzle solver to associate an inadvertently recognized neighboring verification character back to its selection character. It makes the lookup character harder to find, but results in a great degree of selectivity. A table employing this last technique has less distinction between selection and verification character sets, especially if it cooperates with only one puzzle. A table that can be used to correct plain or cipher characters with equal ease is bidirectional.

The table configuration shown in FIGS. 1A–1D requires that the lookup character be a plain character and that the guess-pair's cipher character be the "guess" character to be either verified or corrected. A table of this type is called cipher correcting.

The opposite type of table, called plain-correcting, is also possible and practical. In such a table, the selection characters correspond to the ciphertext and the verification characters are plain characters corresponding to the developing solution. The use of a conforming means in a plain-correcting manner influences the puzzle solver's strategy because a corrected guess-pair retains the chosen cipher character. Therefore the puzzle solver can make sure a useful guess-pair will be revealed by choosing a cipher lookup guess character from among the undecoded characters of the ciphertext.

This latter ability can also be granted to the puzzle solver with the preferred cipher-correcting device by excluding from the selection alphabet any plain characters not used in the message. Then if a plain lookup character can't be found among the selection characters, the puzzle solver is tipped off to the fact that it isn't needed before completing a conforming step and incurring a score penalty. He or she can then choose a more useful lookup character from among the selection characters that are present.

Examples of Conforming Devices

I will now give a few examples of the manifold types of conforming devices that may be used as the conforming means. When possible, each example device includes a cipher which cooperates with the cipher and devices 13 of FIGS. 1A–1D, to make understanding and comparison of the devices easier. Since only one of these devices would be provided for a puzzle, the cipher is nevertheless to be considered transient.

Figure 5:
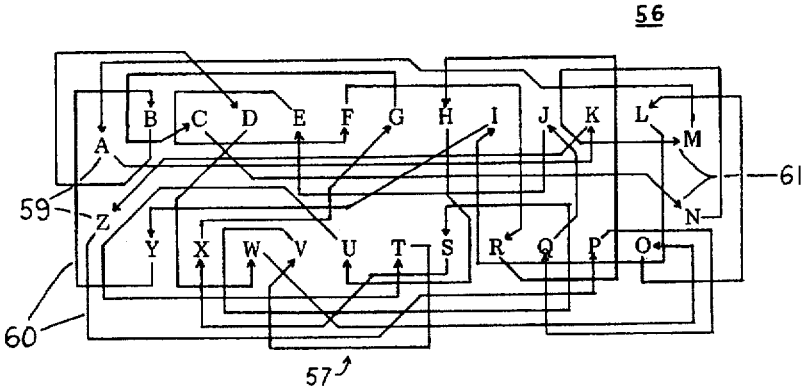
FIG. 5 is a representation of a circuitous course conforming device, which is still another preferred embodiment of the conforming means of the present invention.

The device of FIG. 5 is a circuitous-course conforming device 56, which is a type of conforming device based on a circuitous network 57 of courses to be followed from the selection characters to their corresponding verification characters. In this example, one union alphabet serves as both cipher and plain alphabets, and as both selection and verification alphabets. Therefore each character 59 has both cipher and plain interpretations. This is possible because both cipher and plain alphabets are letters of the same (Roman) alphabet, but two distinct alphabets work equally well in this type of device. The courses follow paths which are defined by lines or arrows 60 with arrowheads 61, and specific rules regarding direction of travel.

The device is used as follows: A puzzle solver wishing to conform the guess-pair "A/Y", using the plain character "1" as the lookup character, would search the characters 59 in the device for the character "A". Upon finding it, he or she would follow the course defined by the arrow which originates at "A", through the circuitous network 57 of intersecting arrows to its terminating point, indicated by an arrowhead 61. In this example, the arrowhead points to the character "K". Therefore, the puzzle solver knows that a plain "A" is represented by a cipher "K", and the guess-pair "A/Y" is to be replaced by the conformed guess-pair "A/K".

The courses defined by the lines or arrows 60 should take a complex interwoven or circuitous route so the puzzle solver's can follow only one at a time. For example, the characters "E" and "F" are neighbors, but the cipher-pair "E/F" is defined by an arrow that loops around the "C". More or less circuitousness may be necessary to provide the desired selectivity for a given puzzle solver, and the complexity of any given device is a compromise between various factors. It should be difficult for someone who is unfamiliar with a particular cipher to spot an entire arrow 60 with its two characters 59 in one glance.

If the circuitous courses are defined by two spaced lines instead of a single arrow, and the courses have "over-passes" and "under-passes" at crossover points, the device can be made to appear similar to a labyrinth-type 3-D maze.

Figure 6:
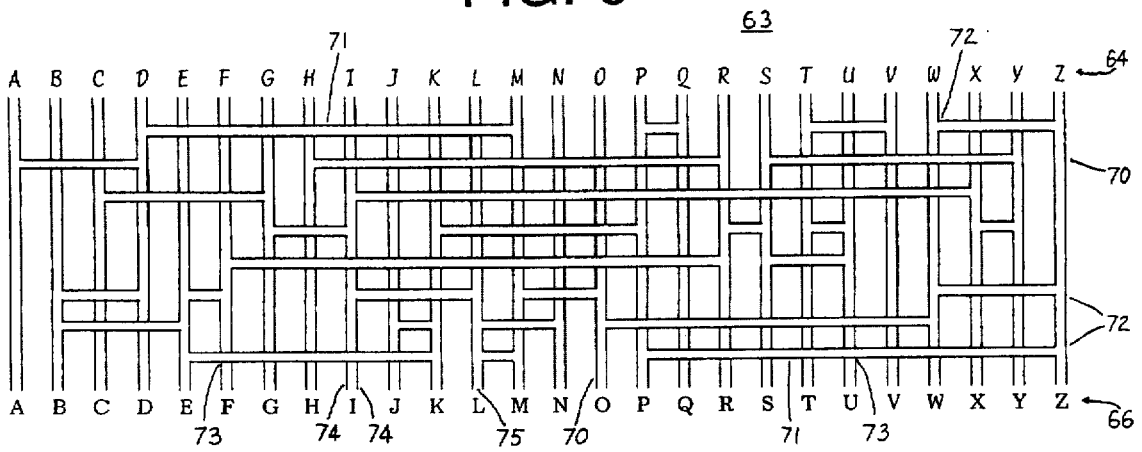
FIG. 6 is a representation of a labyrinth-type circuitous course conforming device with traversal paths, which is another preferred embodiment of the conforming means of the present invention.

FIG. 6 shows such a labyrinth-type device 63 with separate plain alphabet 64 and cipher alphabet 66. The plain alphabet 64 is identified to the puzzle solver by the script-style font. However, this is a matter of design, and any other means of identifying the two alphabets is equally suitable. The use of two separate alphabets eliminates the need for arrowheads and makes the device bidirectional, if they are both alphabetized. FIG. 6 is a circuitous-course device but it has an additional element, namely secondary traversal paths 71 connecting pairs of primary paths 70. The primary paths to go from one character to its opposite type character but do not define the cipher-pairs; instead, the courses defining cipher-pairs switch primary paths 70 at every traversal path 71, according to definite rules. The rules are that a puzzle solver following a primary path 70 from one character to its opposite-type character will turn at every 3-way intersection 72, always in alternating directions. That is, either a right turn followed by a left turn or a left turn followed by a right turn, relative to the direction being traveled. The turns always come in pairs, and after every odd-numbered (1st, 3rd, etc.) turn, a traversal path 71 is followed all the way to its other end where it forms a tee at another 3-way intersection 72. There is no change of direction at a crossover point 73. If the puzzle solver desires, he or she may follow a course by drawing a line in the space 75 between the two printed lines 74 defining each path. Alternatively, a circuitous-course device with secondary traversal paths may have these paths defined by only a single line, or any other means that can support the necessary definite rules.

Figure 7:
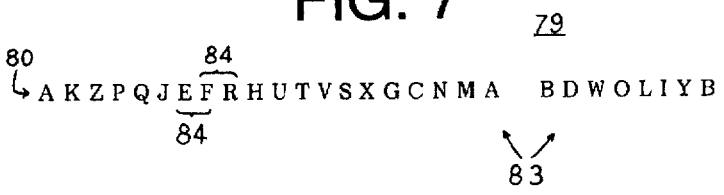
FIG. 7 is a representation of a relative position conforming device, which is still another preferred embodiment of the conforming means of the present invention.

FIG. 7 shows a relative-position type device 79, so named because indication of cipher-pairs is based upon character sequence and proximity. If the cipher and plain alphabets have some characters in common, then only the union alphabet 80 needs to be included, as is the case in this example. The characters of FIG. 7 are divided into two groups 83 because of the cipher which it represents. Other ciphers could result in one group to many groups.

Relative position devices can operate according to manifold schemes. In the example scheme of FIG. 7, every pair of adjacent characters 84 within the same group 83 is a cipher-pair: the left character to be interpreted as the plain character and the right character to be interpreted as the cipher character. Wherever cipher-pairs overlap, the characters have both plain and cipher interpretations, but at the ends of a group 83, the left end character has only a plain character interpretation and the right end character has only a cipher character interpretation.

A puzzle solver wishing to conform the guess-pair "A/Y" would scan the device 79 from left to right for the first "A" he or she can find. This "A" happens to be the first character of the first group. The next character to the right is then the cipher character which substitutes for "A" in the ciphertext. This cipher character is a "K", so the conformed guess-pair is "A/K".

That the device of FIG. 7 has a degree of selectivity is surprising, considering the way it is used. It is probably a result of the typical puzzle solver's inability to comprehend and remember relationships as complex as cipher-pairs while quickly scanning a scrambled alphabet in search of a particular character, the lookup character. This is only one of many ways that cipher-pairs can be revealed by the relative position of characters.

Each of the devices presented so far may be printed on one substrate with the puzzle and other elements of the invention. While this is preferred, the elements of the invention may be provided on separate substrates so long as they are keyed to match the parts that cooperate. Other types of devices can be provided in harmony with the invention which are particularly adapted to not being provided on the same substrate with the other elements of the invention. Some of these external devices incorporate a number of cooperating parts.

Figure 8:
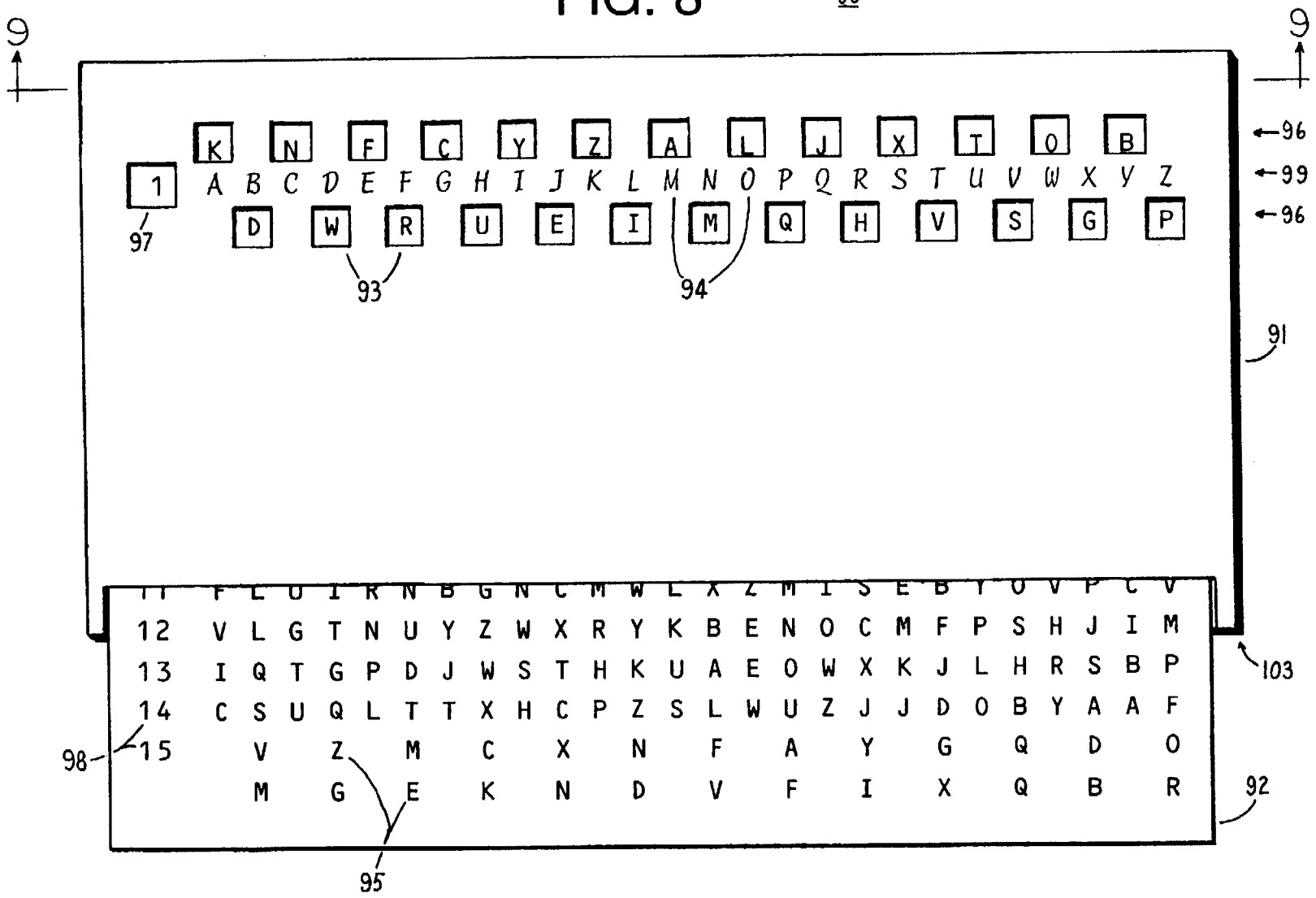
FIG. 8 is a front view of an external setable conforming apparatus, which is another embodiment of the conforming means of the present invention.
Figure 9:
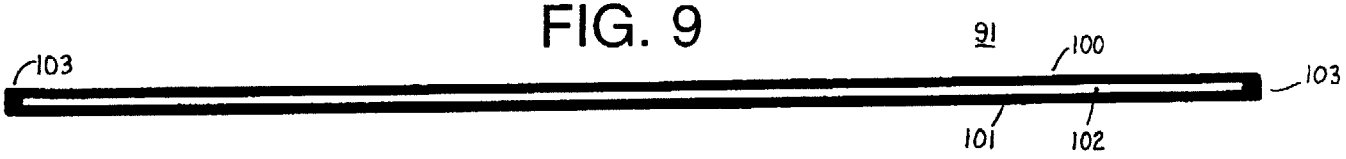
FIG. 9 is a cross-sectional view of the conforming apparatus of FIG. 8, taken along the line 9—9 in FIG. 8.
Figure 10:
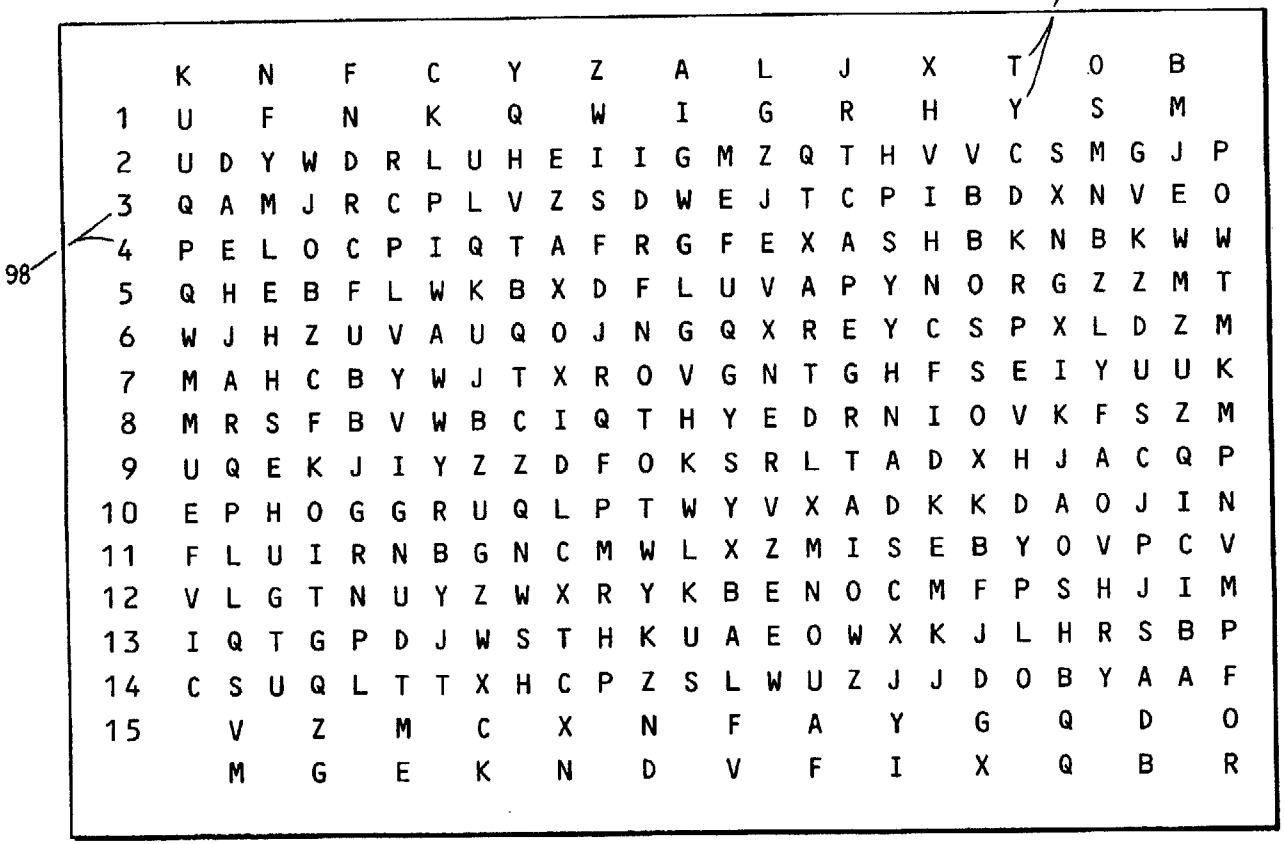
FIG. 10 is an unobstructed view of the card shown partly obstructed in FIG. 8.

For example, consider the external setable conforming apparatus 90 shown in various views in FIGS. 8, 9, and 10. This apparatus includes a cardholder 91 and a card 92. The cardholder 91 has voids forming windows 93 in the top panel 100 to expose selected portions of the card 92 it is holding. The plain characters 94 of the plain alphabet 99 are printed on the face of the cardholder 91 with one plain character 94 being associated with each window. The cipher characters 95 of the cipher alphabet are printed on the card 92, arranged so they line up with the windows one cipher at a time. The example of FIG. 8 is cipher-character correcting. The windows 93 are arranged alternately between two rows 96 to improve selectivity. A modified cardholder with camouflaging indicia (not shown) between windows would further increase selectivity, as would temporarily removable covers over each window, such as slidable doors or liftable flaps (not shown). The cardholder 91 also has an additional void forming a keying window 97. The keying window 97 permits a keying puzzle number or cipher number 98 on the card 92 to be selected and aligned in view, so the proper cipher cooperating with a given puzzle can be located.

FIG. 9 shows a cross section view of the card holder 91 taken at 9—9 in FIG. 8. The card 92 does not reach the line 9—9. FIG. 10 shows the top of the card 92 in full view. The reverse side may be blank or may have additional ciphers, each unique and uniquely keyed to a puzzle.

A puzzle solver wishing to play the game by solving puzzle number 1 would insert the card 92 into the card holder 91 and line up the desired cipher number 98 in the keying window. The device 90 is shown in FIG. 8 with cipher 1 properly aligned. The puzzle solver wishing to conform the guess-pair "A/Y" would look for "A" among the plain selection characters 94 printed on the card holder 91 and compare the cipher verification character found in the window nearest the "A" to "Y". In this case the verification character is "K", so the conformed guess-pair is "A/K".

FIG. 10 exemplifies transience in that it includes fifteen separate ciphers, which are random, not related to one another, and which have no meaning in and of themselves, nor any meaning nor usefulness prior to solving begins or after solving is complete. Because of the requirement for the ciphers to be transient, enough ciphers on enough cards should be provided so each puzzle will have its own cipher. Perhaps at some point it is practically impossible for a puzzle solver to remember enough of a particular cipher from a large pool of used ciphers to prejudice his or her guesses, even if the puzzle solver recognizes the cipher number and knows it's a repeat. This would make it possible to provide a limited number of cards with all unique cipher numbers and to key an unlimited number of puzzles by these cipher numbers. A number of cipher wheels keyed by wheel number and wheel setting could also be used as a conforming device, assuming the requirement of selectivity can be met through the indicia or construction of the wheels and/or the manner in which they are used.

A conforming device may also be an electronic device having an input means, output means, and internal circuit. The input means is for inputting a cipher number or puzzle number at the commencement of a game to establish the cipher that will be accessed. The device will then be ready to conform guess-pairs. The input means is used to enter one or both characters of every guess-pair. In its simplest form, this device receives only the lookup character and immediately responds by displaying the verification character on the output means. The internal circuit is responsible for generating the proper character for every legal input combination. This internal circuit could be a single chip microcomputer, but it doesn't have to be. A combinational logic circuit with just enough memory to hold the cipher number and some supporting interface circuitry could also perform this function. A personal electronic spelling checker or personal electronic notebook could easily be modified or designed to also perform this function, relative to the complexity of the function they already perform.

Figure 11:
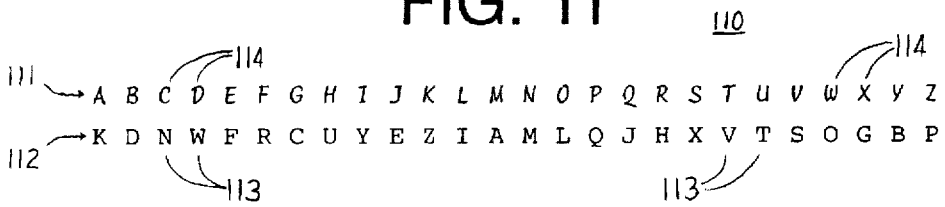
FIG. 11 is a representation of a cipher key, which is part of still another preferred embodiment of the conforming means of the present invention, when used with the aid of a selective view-blocking means (not shown) or an assistant player.

FIG. 11 shows a schematic of a cipher key 110 that includes no inherent selectivity. It is simply a plain alphabet 111 and a corresponding cipher alphabet 112, one of them usually being in alphabetical order to encourage its use as the selection alphabet. Because of its lack of inherent selectivity, an assistant player or a selective view-blocking means such as the puzzle solver's fingers must provide the selectivity. The view blocking means should block the puzzle solver's view of the cipher characters 113 near the search area until the proper plain selection character 114 is found. Then it must be of a shape so it can be moved into a position that only reveals the one desired cipher character 113. Alternatively, if an assistant is used, the puzzle solver informs the assistant of his or her guess-pair to request that it be conformed. The assistant references the cipher key 110 and replies with the conformed guess-pair or maybe just an affirmation when the guess-pair is correct.

Figure 12A:
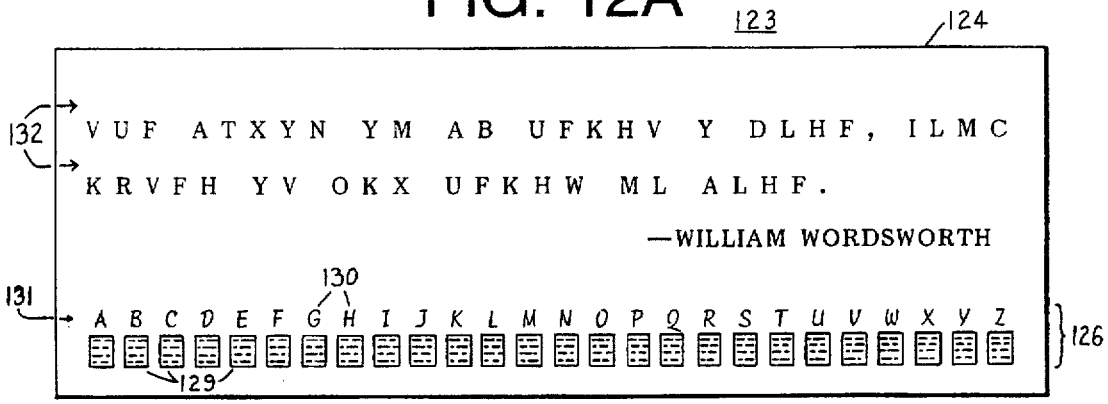
FIGS. 12A and 12B are representations of a preferred embodiment of the present invention showing a removable-surface conforming device, which is yet another preferred embodiment of the conforming means, shown before and after the game is played, respectively.
Figure 12B:
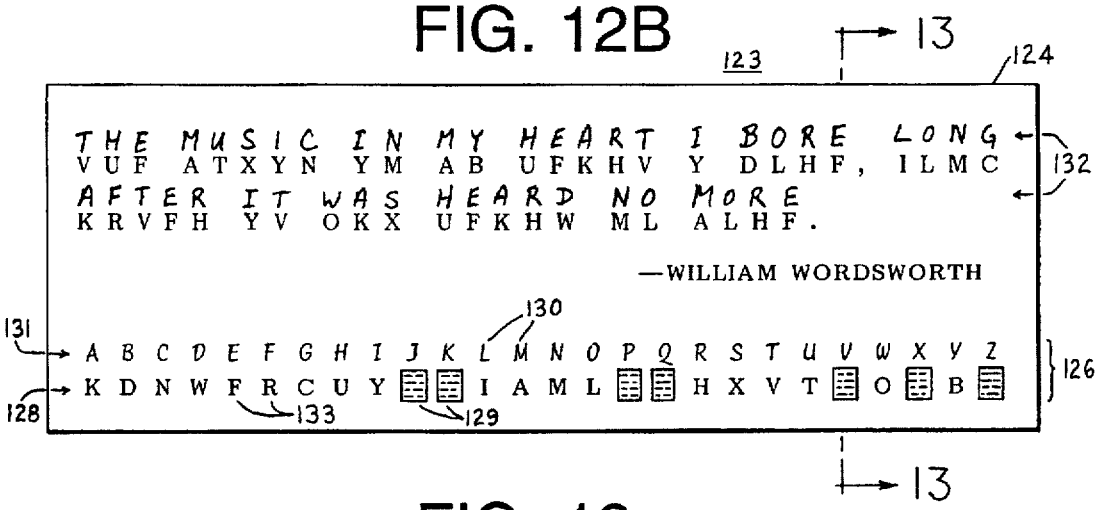
Figure 13:
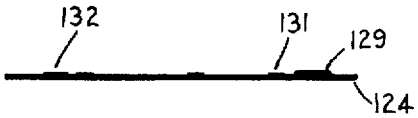
FIG. 13 is a cross-sectional view taken along the line 13—13 of the game apparatus shown in FIG. 12B.

FIG. 12A shows a cryptographic guessing game 123 with all the mandatory elements printed on a substrate such as a paper card 124. The conforming device at the bottom of the card 124 is a removable-surface conforming device 126. This type of device is selective because the characters of one of the alphabets, in this example the cipher alphabet 128 have all been covered with a well-known type of scratch-removable surface 129. The plain characters 130 of the selection alphabet 131 are easily seen. FIG. 13 shows the card of FIG. 12B in a view taken at the line 13—13.

When the puzzle solver wants to conform a guess-pair, he or she finds the plain lookup character of the guess-pair among the visible selection characters 131 and scratches off the associated scratch-removable surface 129. This reveals the cipher verification character 133 which is matched (in cipher-pair relationship) with the plain lookup character. He or she then conforms the guess-pair and updates the developing solution 132 with it. FIG. 12B shows the puzzle and card of FIG. 12A, solved, and after the necessary cipher-pairs have been revealed. As the game progresses, this type of device automatically shows which potential lookup characters were already used. Also, it provides the highest degree of selectivity for those puzzle solvers who find it difficult to use the devices disclosed hereinbefore. Another construction would have been to cover the cipher characters with peel-off tabs, or any other type of individually removable surface.

Figure 14A:
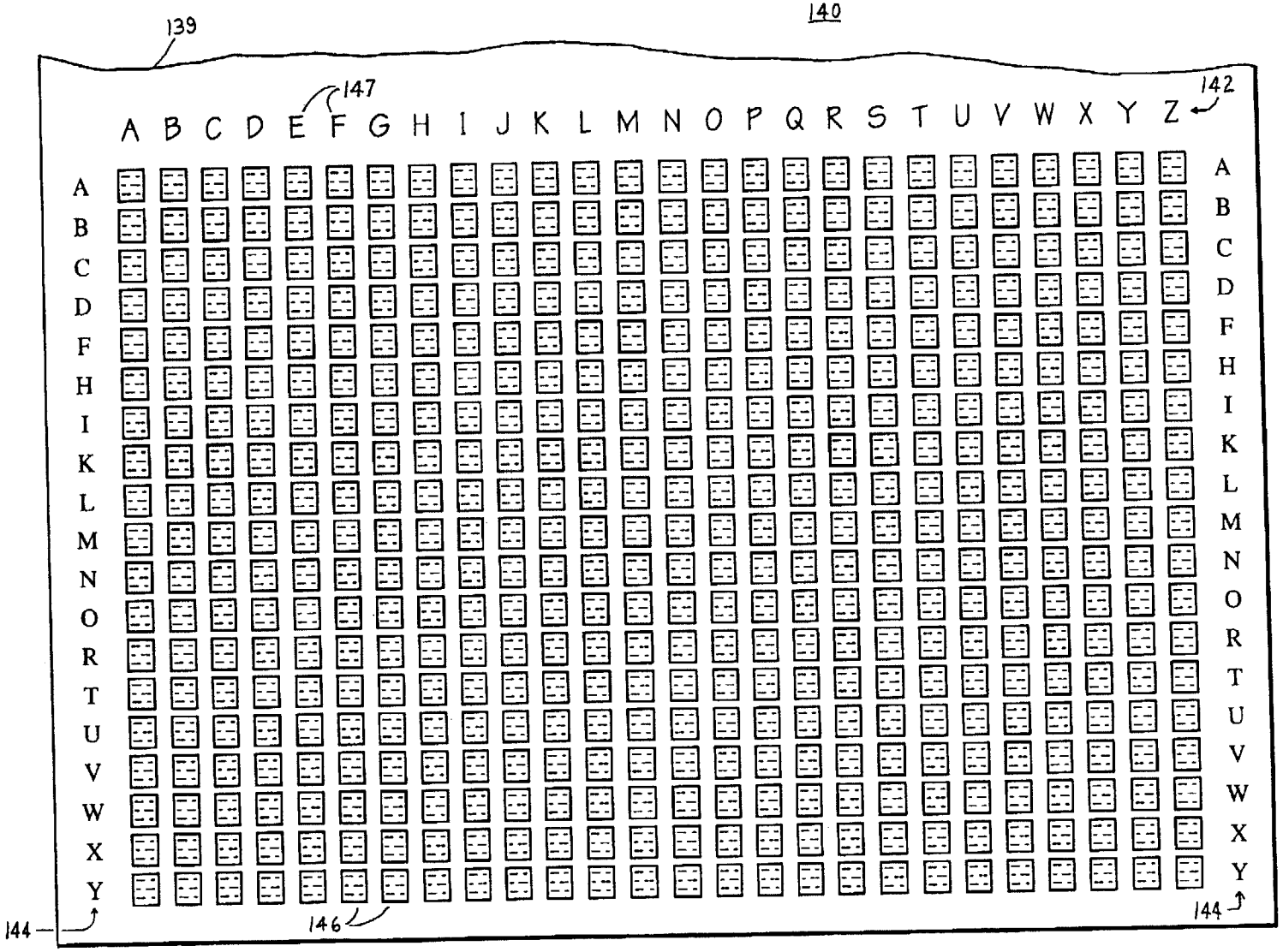
FIGS. 14A and 14B are representations of a matrix removable-surface conforming device, which is another of preferred embodiment of the conforming means of the present invention, shown before and after use, respectively.
Figure 14B:
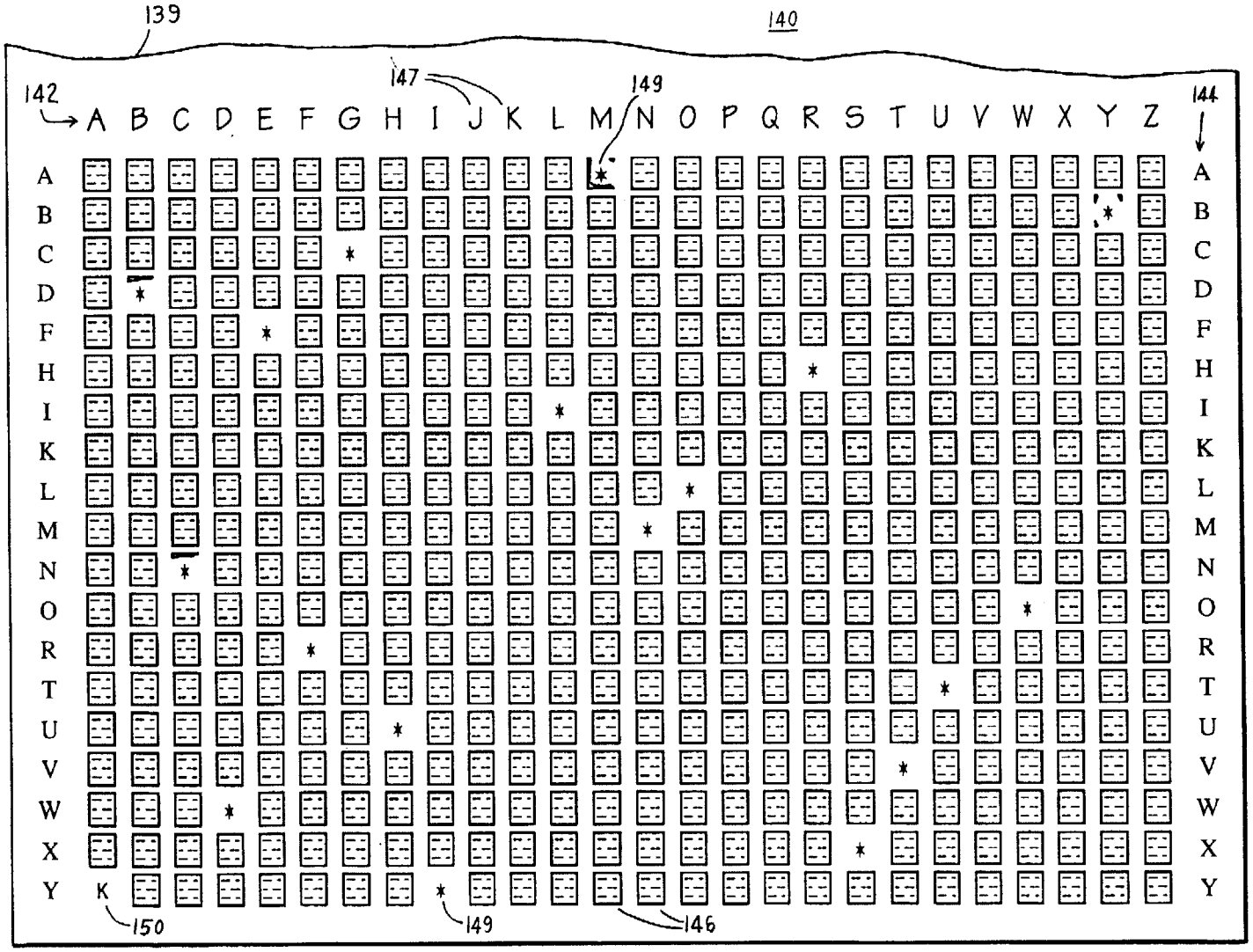

FIG. 14A shows a matrix version of the removable-surface device 126 of FIG. 12A. It too can be provided with the puzzle printed on the same substrate 139, but that part is not shown to save space. In a matrix removable-surface conforming device 140 the plain alphabet 142 and cipher alphabet 144 are arranged in arrays at right angles, to define a matrix of scratch-removable surface 146. As a matter of design, multiple plain or cipher alphabets may be provided. With this type of device 140, a puzzle solver wanting to conform the guess-pair "A/Y" would find the plain "A" among the plain selection characters 147 along the top, and scratch off the removable surface at the intersection of column "A" and row "Y". As can be seen in FIG. 14B, the character "K" was uncovered, indicating that conformed guess-pair is "A/K". FIG. 14B shows the device after the entire puzzle of FIG. 1A was solved. The asterisks 149 indicate that the guess-pair was correct, and any cipher character 150 indicates that the guess-pair was incorrect and needed to be corrected to that cipher character. A further understanding of the device can be obtained by examining FIG. 15, which shows what it looks like with all removable surfaces removed, or, equivalently, just before the removable surfaces are applied during manufacture. This type of device creates a more detailed record that is difficult or impossible to alter to improve the appearance of how the game went once the puzzle is solved.

Figure 15:
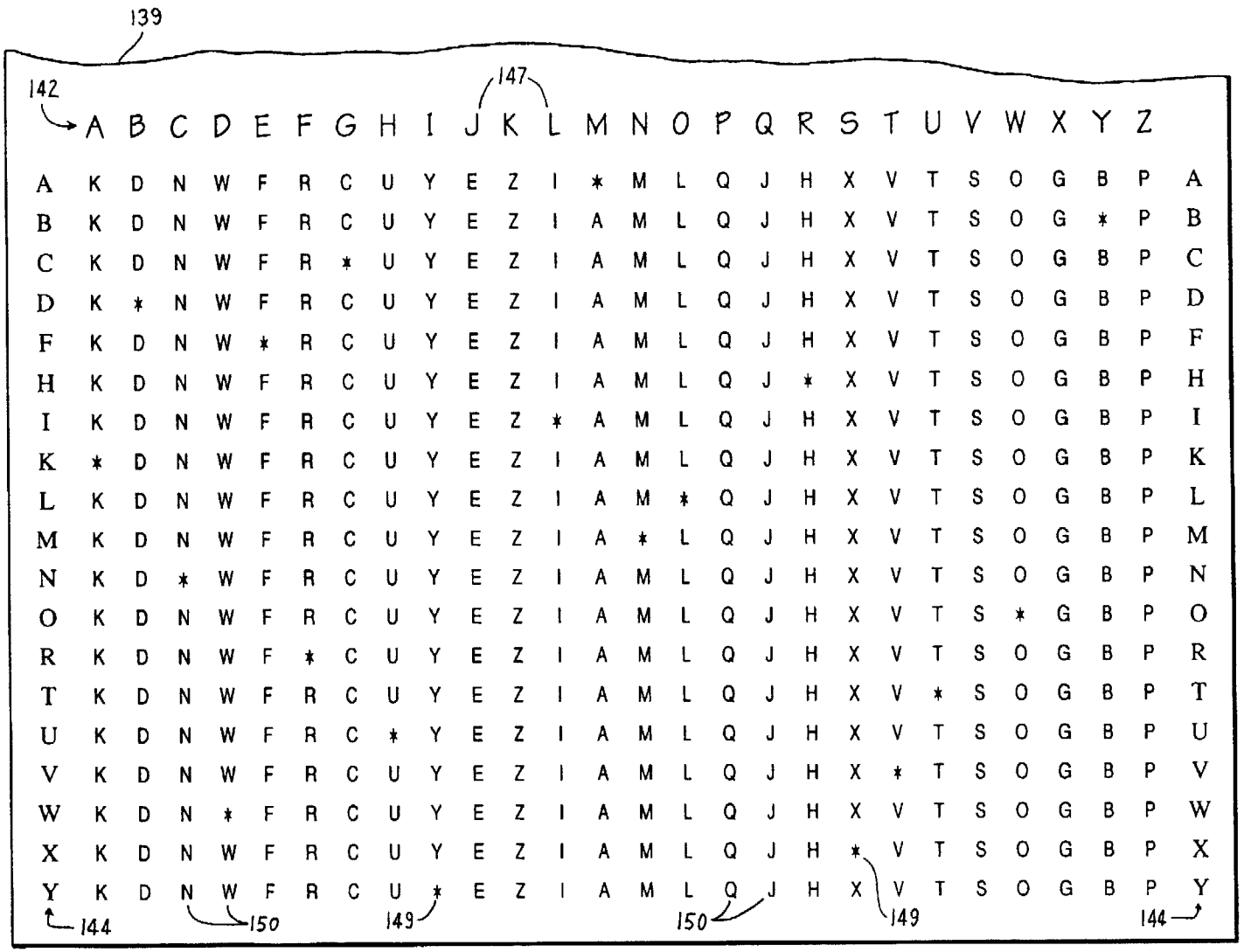
FIG. 15 is a front cut-away view of the device of FIGS. 14A and 14B with all removable surfaces removed.
Figure 16:
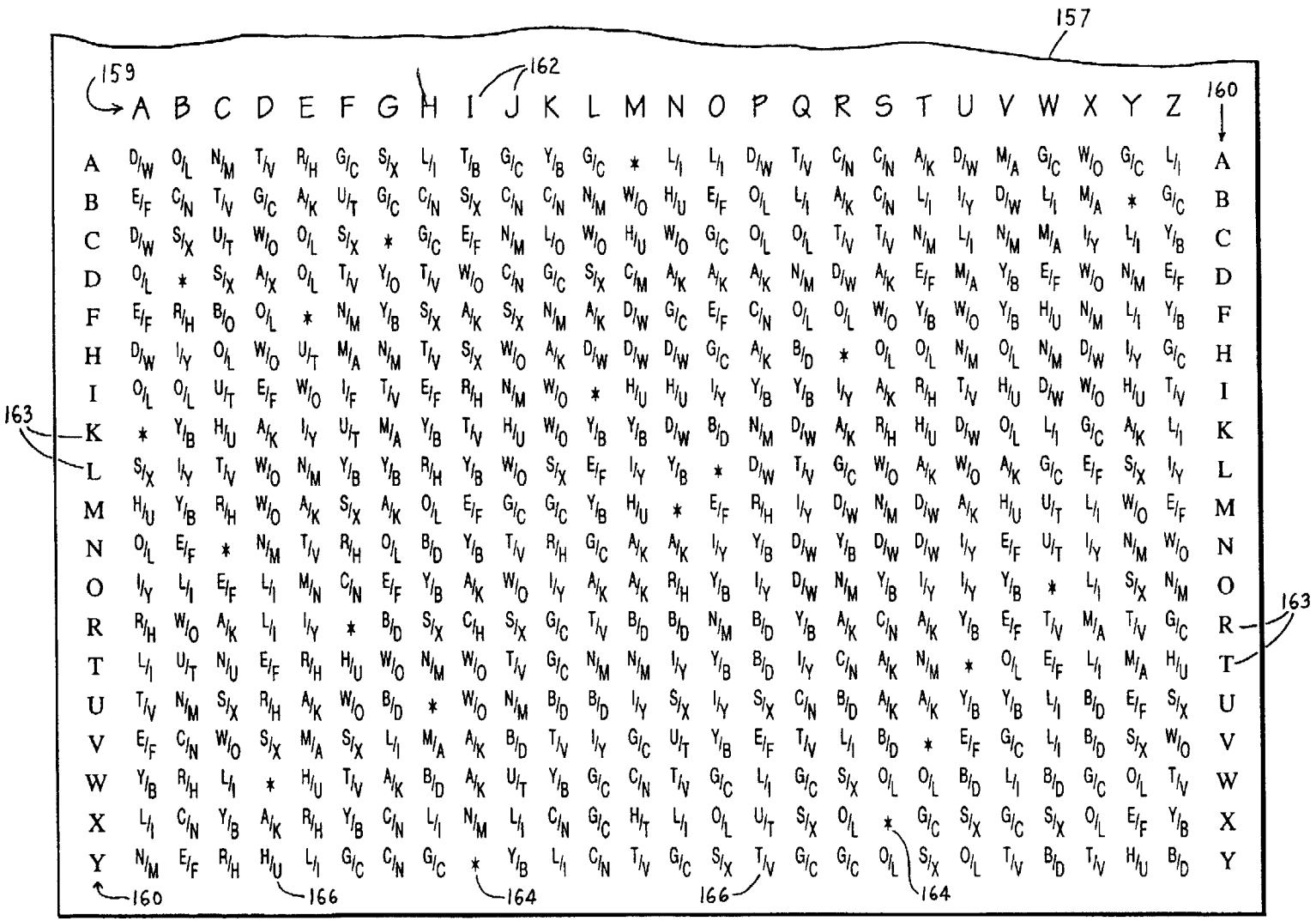
FIG. 16 is a front cut-away view of a dual-correcting class, matrix removable-surface conforming device, which is analogous to the device of FIG. 15 but is yet another preferred embodiment of the conforming means of the present invention.

FIG. 16 shows how the device of FIGS. 14–15 could alternately be made to be a dual-correcting class conforming device. FIG. 16 corresponds to FIG. 15 in that it too shows a matrix removable-surface device with all the scratch-off surface removed. It too has a plain alphabet 159 and a cipher alphabet 160, but neither is designated the selection alphabet because the conformed guess-pair is not selected according to one of the guess-pair characters. Rather, it is selected by the device pseudo-randomly. At each intersection of a plain alphabet character 162 and cipher alphabet character 163 is either an asterisk 164 or a predetermined conformed guess-pair 166. The asterisk indicates the guess-pair was correct. The predetermined conformed guess-pairs are all cipher pairs (as must be all conformed guess-pairs) having a plain character on the left, slash character, and cipher character on the right. Almost always, the plain character does not match the column it is in and likewise the cipher character rarely matches the row it is in, so the puzzle solver cannot strategically choose a correction in the event his or her guess-pair turns out wrong.

While all conforming devices in the accompanying figures have 26 cipher-pairs per cipher, a full set for the English language, it is not absolutely necessary to provide so many. In a plain-character correcting conforming device, only the cipher-pairs actually used by the puzzle composer to originally encipher the message need to be provided. A cipher-character correcting or bidirectional conforming device benefits from having all the plain characters available, but the game would be little changed if some infrequently-used plain characters (such as "J", "Q", "X", and "Z" in English) were left out. The minimum set of plain characters and the minimum set of cipher characters that are actually needed to make a conforming device practical for the invention is termed the representative plain alphabet and the representative cipher alphabet, respectively.

It is difficult to establish a minimum number of cipher-pairs which must be included in a conforming device. What matters more is the way they are presented, which cipher-pairs are omitted if a full set for the language in use is not included, and the type of the control the puzzle solver has over which cipher-pair is revealed. At the very worst, the puzzle solver must have the ability to verify on demand the correctness of all but the most obviously correct guess-pairs, and in response to an incorrect guess-pair, have revealed any one cipher-pair, which is to become the conformed guess-pair.

Control over which cipher-pair is revealed in response to an incorrect guess-pair is not as important as the fact that a cipher-pair is revealed. The selection of a cipher-pair which has one character in common with the guess-pair is preferred. That the conformed guess-pair be a previously unknown cipher-pair is preferred. But even the revelation of a randomly-selected cipher-pair falls within the spirit and scope of the invention. This is in harmony with the idea that correct guesses are verified with no penalty and incorrect guesses are treated as evidence that help is needed, so help is given with a penalty. Thus, the time at which to provide help is determined automatically by the conforming means. This is in contrast to old methods of providing help, such as providing hints up front, or requiring the puzzle solver to detect and admit being stuck to obtain a hint, or letting him or her decide to obtain a hint at any time, or other old techniques. The penalty for an incorrect guess-pairs could be the lack of a reward for a correct guess-pair, or any other consequence that might be established to motivate the puzzle solver to guess correctly.

One benefit of correcting one character rather than both characters of a guess-pair to reveal a cipher-pair is that not only the time but also the place at which to provide help is determined automatically by the conforming means. Another benefit, or another aspect of the same benefit, is that the puzzle solver can exercise some control over what kind of help is given, should the guess-pair be wrong. This enables a puzzle solver to form guess-pairs while balancing his or her confidence in a guess-pair with a somewhat predictable benefit of receiving help in case its wrong. However, some puzzle solvers may prefer to leave this to chance and be surprised by what kind of help they receive.

If meaningful control is provided, it is exercised through the lookup character and the selection characters. This can be either a choice of plain characters among the plain representative alphabet or a choice of cipher characters among the cipher representative alphabet. There should be a wide enough choice so the puzzle solver is not constrained and so it is not obvious which cipher-pairs are the most beneficial to look up. If the representative cipher alphabet is always used as the selection alphabet, then meaningful control is exercised only through the cipher characters and there is no need for including cipher-pairs that were not actually used to generate the ciphertext from the message. However, if meaningful control can be exercised through the plain characters, then unused cipher-pairs in the device enhance the challenge and level of skill by acting as decoys. The most essential cipher-pairs to be included are those likely to be selected when the puzzle solver has little confidence in his or her guess-pair.

Under some circumstances, it is possible to omit certain cipher-pairs from the conforming device, even though they were used to originally encipher the message. These include cipher-pairs that, for most reasonable sequences of guesses the puzzle solver is likely to follow, can be guessed with certainty at some stage of solving, or cipher-pairs that are likely to remain unrevealed only when the stage of solving has advanced to the point where a correct outright guess can be made. While such a conforming device with some used cipher-pairs omitted is not preferred, it may still be within the spirit and scope of the invention, depending on what cipher-pairs are provided, the method with which the provided cipher-pairs are to be revealed, and whether or not the omissions cause serious problems in solving the puzzle according to the methods of the present invention.

The Message

The message from which the ciphertext is made can be much more than just the quotation. A group of names of things belonging to some category is another type of message already known in the art of standard cryptogram puzzles. The names may be one or more words each and should be clearly separated one from another. The category is revealed through the attraction clue. An example message, for the category "DINNER TIME", is "SALAD; T-BONE STEAK; BAKED POTATO; PEAS AND CARROTS; APPLE PIE." The semicolons may remain unenciphered if the ciphertext is printed in a few full lines, or each name may be printed on a new line.

Another type of message that may be used with the present invention is an interlocking matrix of words, such as in a crossword puzzle solution. The word matrix of many, if not all, crossword puzzles can be enciphered and provided together with any type of display and any type of conforming device or interactive conforming means. No crossword puzzle definitions need to be provided, but they can be helpful if the message contains unrecognizable word fragments, abbreviations, foreign words, or the like. In that case, only the unrecognizable parts need clarification and the definitions may be exceptionally hard so the cipher must be solved before they make sense. Then the definitions would be more for verification than for hints or clues. Nevertheless, it is preferred to use a crossword message made of only recognizable words and abbreviations.

A crossword message with an interlinear developing solution is preferred because it can be made to look similar to a standard crossword puzzle, with a grid of squares, including blocked out spaces where needed. Instead of numbering some squares, all squares would be identified with a small (probably alphabetic) cipher character in the upper left-hand corner. High quality crossword messages for these cryptographic crossword puzzles would follow conventional crossword puzzle composition rules such as square, symmetric grids, less than 20% of the squares blocked out, all characters belonging to two crossed words, etc. In addition, so definitions may be avoided, the highest quality cryptographic crossword puzzles would be made up of only recognizable words in the dictionary. To provide a reasonable number of cipher clues, the crossword message should normally be at least a 5 by 5 grid with 25 characters.

Figure 17A:
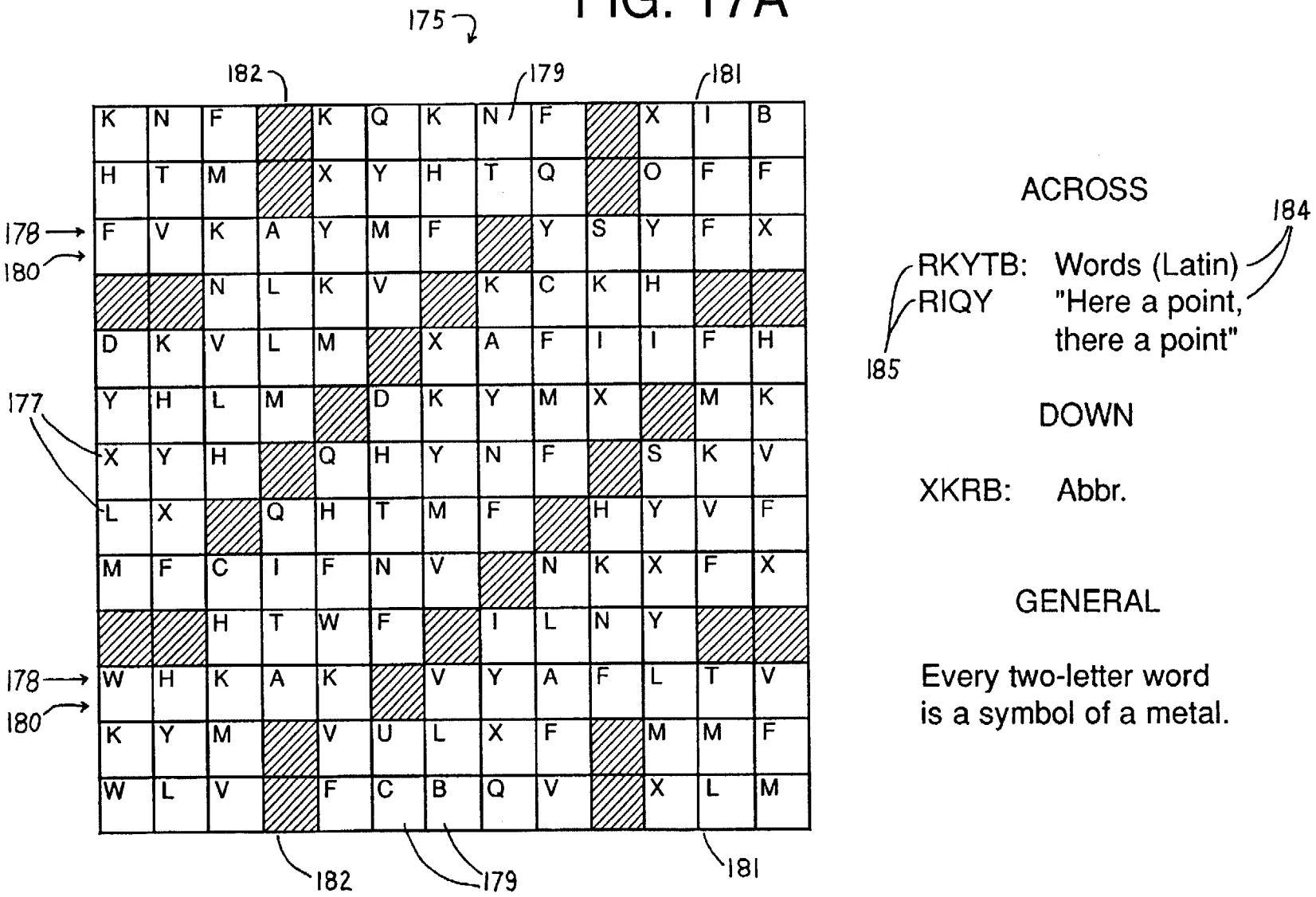
FIGS. 17A and 17B are representations of only the puzzle display and explanatory definitions of a crossword cryptographic guessing game, which is another preferred embodiment of the present invention, shown before and after solving, respectively.
Figure 17B:
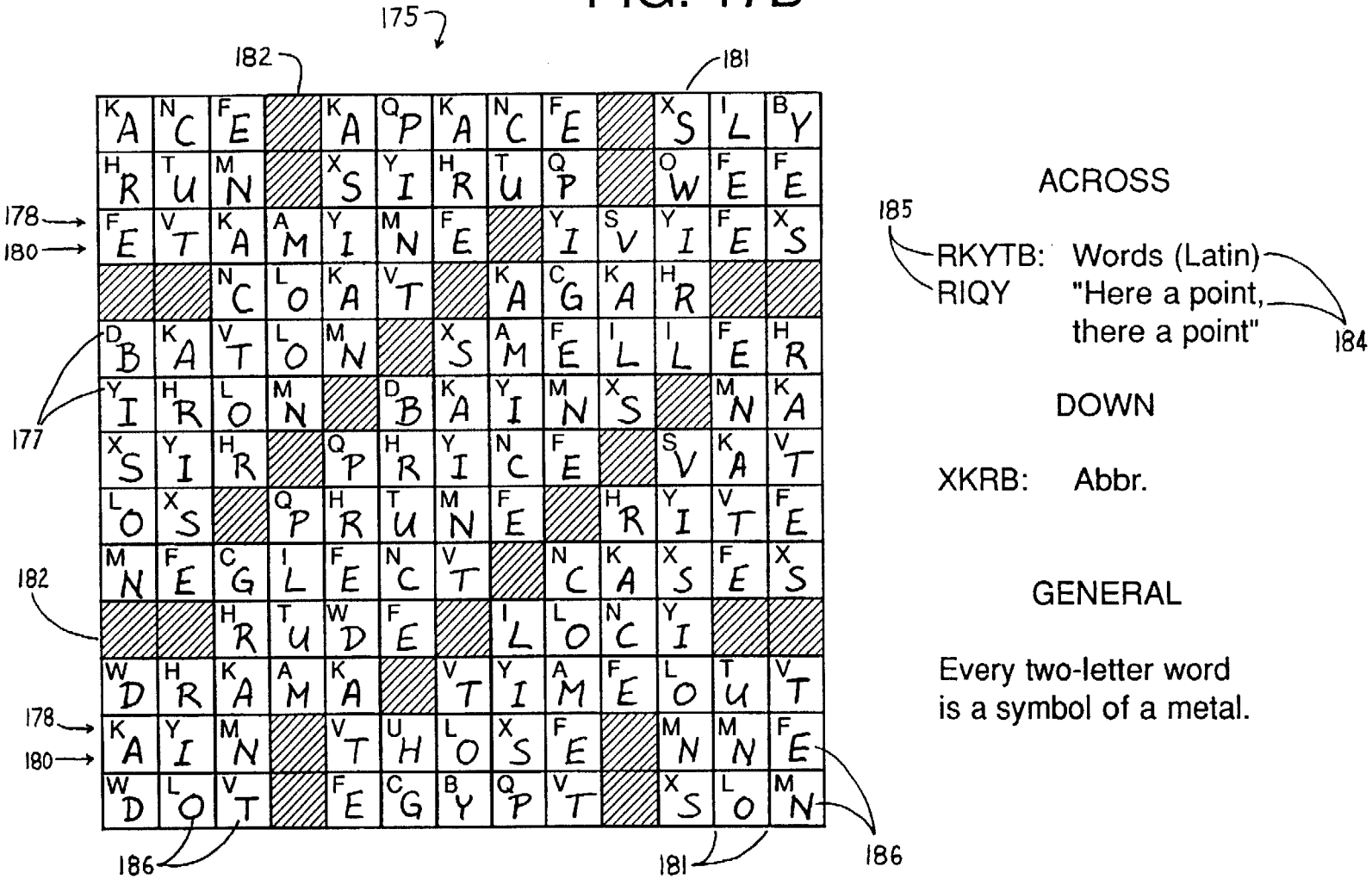

FIG. 17A shows the puzzle display 175 of a cryptographic crossword puzzle for a cryptographic guessing game. It includes the cipher characters 177 which collectively make up the ciphertext 178, and the designated places 179 of an interlinear developing solution 180. Also shown are grid lines 181 more precisely defining the designated places 179, and blocked out squares 182 analogous to spaces in a non-crossword message. The cipher used for this puzzle is the same as that of FIG. 1A–1D, so a conforming device is not shown. The puzzle includes a small number of explanatory definitions 184 for difficult cipher words 185. FIG. 178 shows the same puzzle solved, with all plain character 186 of the developing solution filled in.

The Encipherment Scheme

Additional complexities can be introduced into the ciphertext without changing the spirit of the invention. So far, only simple substitution ciphers have been shown in the examples. These are ciphers in which each plain character has one fixed cipher character substitute, and each cipher character consistently substitutes for the same plain character. Thus, simple substitution ciphers are a consistent, one-to-one replacement scheme. Other characteristic features of the ciphertext of the puzzles shown so far are that spaces and punctuation marks have always been shown, that no transposition or scrambling of characters has taken place, and no character is represented by a like cipher character.

The other methods of encipherment can be used to create puzzles of lesser or greater skill level, but which can still be solved when using a conforming means and a display with a developing solution. The use of the latter two elements and the puzzle solver's skill should have the overall effect of improving his or her score.

One such change in the method of encipherment is that the spaces between words may be treated as characters to be enciphered along with the other characters of the message. (In a computer, spaces are always treated as characters. They just don't print any indicia.) Punctuation may also be enciphered.

Another complicating factor might be to allow cipher characters to represent plain characters which look like themselves, or, equivalently, to not encipher every kind of plain character. If done sparingly, this complicates the puzzle because, using the English language and the Roman alphabet as an example, a given character in the ciphertext could represent any one of 26 plain characters rather than any one of 25 plain characters.

To create an even more challenging puzzle, the puzzle composer may hide the relative frequency and other interrelationship-type clues by using semi-consistent enciphering for frequently occurring characters, especially spaces if they too are enciphered. Semi-consistent ciphers are ciphers in which some plain characters have two or three different cipher substitutes for different occurrences of the plain character, but every occurrence of a given cipher character still always substitutes for the same plain character. The conforming device would be modified so that one plain character corresponds to a number of unique cipher characters. A guess-pair would be considered correct if one of the cipher characters matched. A plain character lookup would reveal all the cipher verification characters but a cipher character lookup would reveal only the one plain verification character.

Note that the opposite type of semi-consistent enciphering doesn't make sense for this invention. This is where different occurrences of the same cipher character could substitute for different plain characters, but every occurrence of a plain character would always have the same cipher substitute. It doesn't make sense because there is no definite way of knowing which of several plain characters a given occurrence of a cipher character is substituting for, unless some definite rules are given as with polyalphabetic ciphers that rotate through a number of simple substitution ciphers by switching ciphers with each consecutive character. Such a puzzle is definite, but would require a very long message to be practical.

The concept of semi-consistent enciphering can be extended to remove as many cipher-type clues as desired, even all of them. However, if all cipher-type clues are removed, the scheme should be called a fully-unique enciphering scheme. In a fully-unique enciphering scheme, each cipher character would substitute for only one occurrence of a plain character in the message. For example, a message that has forty-seven plain characters composed of nineteen different letters of the plain alphabet would use forty-seven different cipher characters. Coming up with forty-seven (or more) unique cipher characters is not difficult, given the variety of alphabets and symbols that exist and the fact that most upper and lower case characters are easily distinguishable. One easy way to encipher the message is to merely number the plain characters of the message. Two-digit numbers can be treated as a single cipher character. The plain characters of the message can be numbered consecutively or in any random sequence, it does not matter. Over several puzzles, if the plain characters are always numbered consecutively, the ciphertext for each message will look very similar except for length and the placement of spaces and punctuation. Nevertheless, the cipher generated will still be transient. As this encipherment scheme naturally results in large conforming devices and more guess/conform/update cycles, it is more suitable to shorter messages.

Another way to complicate the cipher and add an additional level of complexity is to omit some or all spaces from the ciphertext. This type of encipherment removes the clues of word length, and also the locations of word boundaries. Punctuation can also be omitted. As the developing solution unfolds the puzzle solver will see where word boundaries ought to be and will be able to read the message.

Figure 18A:
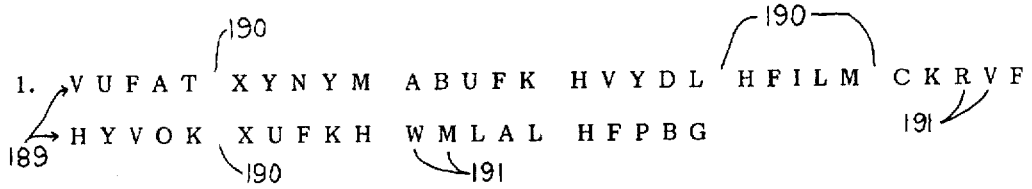
FIGS. 18A and 18B are representations of a puzzle with ciphertext having false spaces and an interlinear developing solution, shown before and after solving, respectively.
Figure 18B:
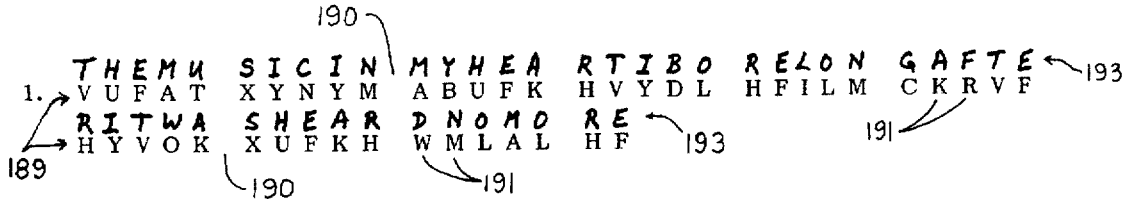

An even further complication of the ciphertext 189 is shown in FIG. 18A, in which false spaces 190 have been introduced every five cipher characters 191. FIG. 18B shows that it is possible to make out the message off the completed developing solution 193 even with false spaces 190. Alternately, the false spaces could have been introduced irregularly to mimic a typical distribution of word sizes. To be fair, the puzzle solver should be advised of the method of encipherment used with each puzzle.

The invention is not limited to Roman letters for ciphertext characters. Any symbols can be used, including Greek letters, numbers, abstract symbols, characters of other alphabets, and so on.

Another way to add a dimension of skill to the puzzle is to encipher frequently occurring groups of plain characters with one cipher character. For example, the groups "QU", "TH", "ING", "TION", and so on, or even entire words can be represented by one cipher character. With this method, the plain selection "alphabet" must include these groups of characters or words to indicate to the puzzle solver what groups are treated as a unit and are therefore permitted to be one part of a guess-pair. Continuing the above example, a guess-pair could be that plain "ING" is represented by the Greek letter alpha.

In addition to the substitution enciphering disclosed so far, random scrambling may also be performed to further complicate the puzzle. Random scrambling is not a method of encipherment because there are no explicit rules for unscrambling by which the original plaintext can be restored. However, scrambling done in addition to a substitution encipherment scheme adds a level of challenge to the invention by obscuring certain types of clues and requiring the puzzle solver to use additional skills to solve the puzzle. The step of deciphering the substitutions is explicitly defined and can be done correctly with only a few clues, after which the step of unscrambling restores the original message through well-known and popular word puzzle techniques.

Figure 19A:
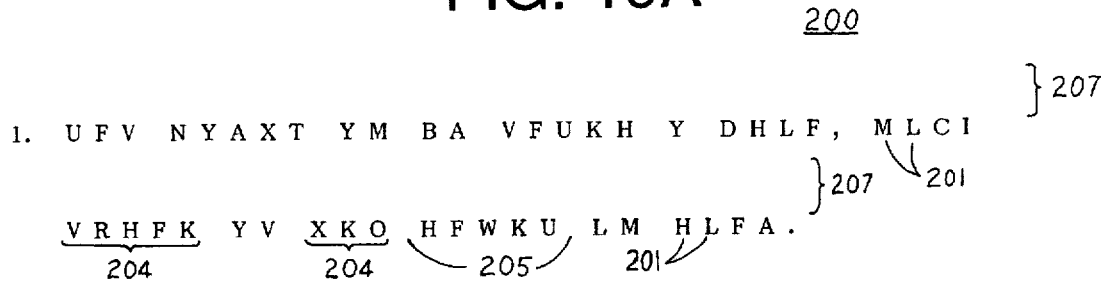
FIGS. 19A and 19B are representations of a puzzle with ciphertext in which the cipher substitution characters were randomly scrambled within each word, and a bi-level interlinear developing solution, shown before and after solving, respectively.
Figure 19B:
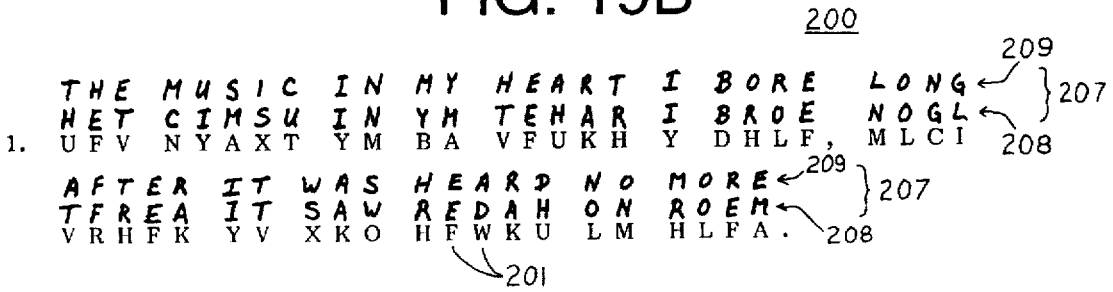

An example of such a scheme is shown in the puzzle 200 of FIG. 19A. In this example, the cipher characters 201 are scrambled within each cipher word 204; the true spaces 205 shown act as bounds across which no character can be scrambled. FIG. 19B shows the same puzzle 200 solved, with a hi-level developing solution 207 correctly filled-in. The bi-level developing solution 207 is for figuring out the substitution cipher on the lower level 208 and unscrambling on the upper level 209, both levels to be worked out simultaneously in a back-and-forth manner as clues appear.

Substitute/scrambling schemes eliminate some clues and make others harder to obtain. But because of the conforming device, the substitutions will always be figured out correctly, assuming no clerical errors. The relative frequency of the characters provides enough clues to make the first step of discovering the substitutions challenging and enjoyable, after which the second step of unscrambling demands an added level of skill.

If the characters of the message are rearranged in a manner that can be reversed using the conforming device, the rearrangement is a transpositional enciphering scheme. In a purely transpositional enciphering scheme, all the characters of the message appear in the ciphertext in an altered sequence. The puzzle solver has to figure out the correct placement of each cipher character with the help of transpositional conforming device.

A transpositional conforming device that is cipher character correcting should have a selection character for every plain character of the message. Since the plain characters are unknown, the position of each plain character is used in its place. A transpositional conforming device that is plain character correcting should have a selection character for every cipher character in the ciphertext. Such a conforming device or means may answer the question, "does the character at position x in the ciphertext belong at position y in plain solution?" The guess-pair is the cipher character at position x and that same character, proposed to be at position y. In a transposional encipherment scheme, the plain guess character and cipher guess characters are equal in appearance and (usually) different in positions in the plaintext and ciphertext, respectively. In other words, transpositional guess pairs represent particular occurrences of characters and not every occurrance of identical characters. Put another way, each part of a transpositional guess pair include a plain or cipher character and its position in the plaintext or ciphertext, respectively. The conformed guess-pair, in harmony with the principles disclosed hereinbefore, would be either equal to the guess-pair if it is correct, or it would be equal to some other transpositional cipher-pair. This other transpositional cipher-pair may or may not have one of the positions in common with the guess-pair, depending on how the cipher-pair is chosen.

As plain characters are figured out or otherwise revealed, the remaining movements of cipher characters will fall into place and become more easily apparent. The puzzle solver may detect a pattern that provides more clues and increases the accuracy of his or her guess-pairs. This of course presupposes the transpositional enciphering scheme is relatively simple.

A simple and flexible transpositional enciphering scheme is random transposition enciphering. This is similar to the random scrambling complexity disclosed above and in FIGS. 19A–19B. However, random transposition enciphering is a true enciphering scheme because there are definite rules by which the ciphertext can be deciphered. The conforming device provides the rules. The random transposition enciphering scheme is simply to move each plain character a small random distance. It could be scrambling the characters within each word, especially if there are no short words in the message. It could also be moving each character randomly without regard to word boundaries. For example, it could be moving each character to a new position within a certain number of characters left or right, such as up to five character positions left or right. The limit could also be a limit on the average move, with no actual limit for any particular character. To form a guess pair involving a particular cipher character, such as a cipher character "R" in a one letter word, the puzzle solver can look to other undecoded cipher letters nearby and know that one of them is the correct plain character. A larger average move will require greater care and a greater level of skill to achieve the same raw score, but because of the conforming device, all puzzles are still solvable no matter how poor the guesses are. This type of transitional encipherment scheme requires only a single level developing solution.

If several puzzles are provided with this random transposition enciphering, it is preferred that they use several different version of the enciphering scheme. For example, the first group of messages may be scrambled within word boundries, a second group may be scrambled within a limited length of move, and the remaining messages may be scrambled within an average length of move. Within each group, the limit or average should increase slightly from one puzzle to the next. Disclosing the particular version used for each message does not give away the solution, but most puzzle solvers would probably want to figure it out themselves.

Virtually any conforming device may be used with random transpositional enciphering. The conforming device may merely reveal what each cipher character needs to be replaced with on the developing solution without indicating the movement that was made. That is, without indicating where the plain character came from in the transposed ciphertext. This can create ambiguities for the puzzle solver when two or more identical character in the ciphertext are within range of movement. The invention can tolerate the ambiguity because the developing solution will be updated properly regardless of how the ambiguity is resolved. If the puzzle solver resolves the abiguity incorrectly, it may lower the score but not the prospect of solving the puzzle. It does not even matter if the puzzle solver ever resolves the ambiguity.

As previously explained, the conforming device must be modified to allow the puzzle solver to look up each character (cipher or plain) uniquely, treating identical letters of the alphabet that occur in more than once as different characters, because they occupy different positions in the puzzle. The conforming device may additionally reveal the movement that was made. (Revealing the movement that was made also reveals the character that was moved.) This prevents the ambiguity from arising and allows the puzzle solver to optionally mark the cipher character that was moved to indicate that it was moved back to its plaintext position and is decoded. The conforming device may indicate the movement that was made by including a code for a verification character. For a particular plain character position looked up, such a code could be the position of the cipher character, expressed either in absolute terms or relative to the position looked up (e.g., "4L" for a cipher character that was moved four character positions to the left during enciphering. )

A transpositional puzzle can be implemented on a computer for interactive solving, just like the other types of puzzles disclosed herein. One way to conveniently input transpositional guess-pairs is to have the user manipulate a pointing device such as a mouse with a mouse button. The user would simply click on the ciphertext character that is the cipher part of the guess-pair and drag it to its proposed position on the developing solution, which is the plain part of the guess-pair. (Two separate clicks would also work, but click and drag is preferred.) If the guess-pair is correct, the computer would copy the character from the first position to the second. If the guess-pair is incorrect, the computer would select a cipher-pair to reveal and update the developing solution according to the selected cipher-pair. How the computer selects the cipher-pair to reveal can be a puzzle solver option input to the computer before the game starts or input with each correction, however the puzzle solver wishes. The puzzle solver may also choose what the computer should do with the cipher characters of the ciphertext as they are deciphered, whether to have the computer erase theme mark them as used or leave them alone.

Another transpositional enciphering scheme will now be disclosed. It consists of several basic operations or actions that can be performed on the message to produce the ciphertext. Every action must be reversible or it must have an opposite to make deciphering possible. The puzzle solver is allowed to know what the actions are, how they work, etc., but he or she does not know which actions were involved in the creation of the ciphertext of a particular puzzle nor the order in which they were applied. Some example actions are:

WB: Word Backwards. Reverse the order of the characters of each word (i.e., spell every word backwards).

WR: Word-wide Right rotate. Move every character except the last character of each word one character-position to the right. Move the last character of each word to the first character-position of the same word.

WL: Word-wide Left rotate. Like WR, but to the left.

PR: Puzzle-wide Right rotate. Move every character except the last character of the puzzle one character-position to the right, skipping over spaces or vertical lines. Move the last character of the puzzle to the first character-position of the puzzle.

PL: Puzzle-wide Right rotate. Like PR, but to the left.

The application of two to four of these actions makes ciphertext that is quite unintelligible but full of clues visible to someone who knows what to look for. The actions of the example above do not influence spaces between words. Many other actions could be invented.

Figure 20A:
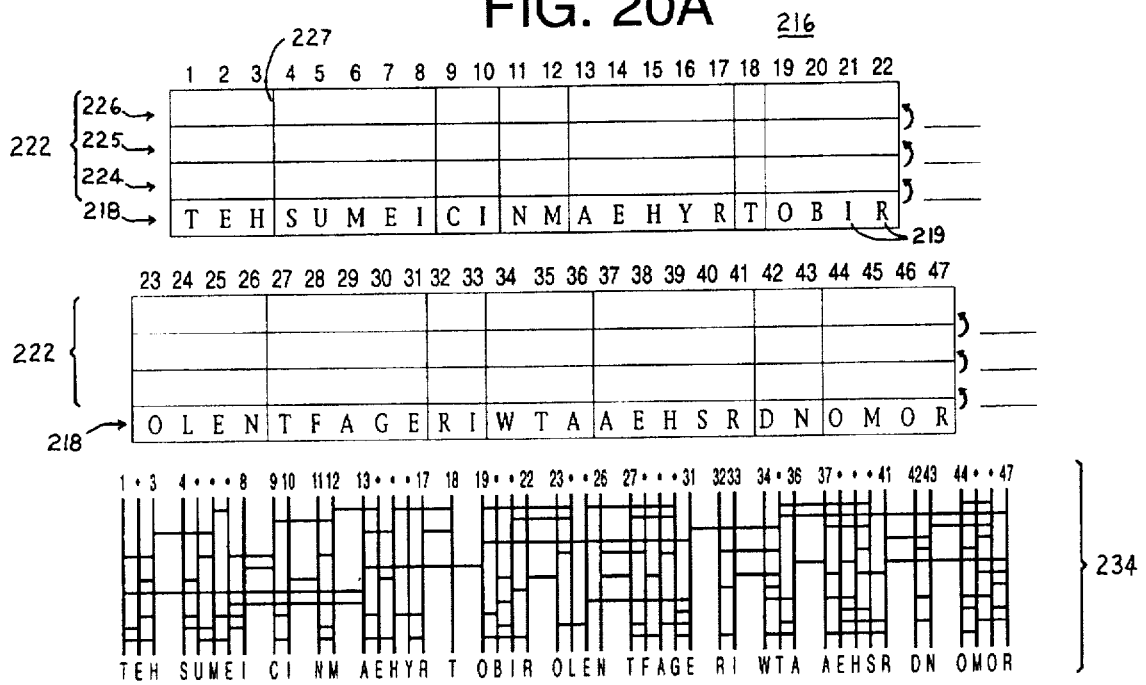
FIGS. 20A and 20B are representations of a cryptographic guessing game with purely transpositionally enciphered ciphertext, a tri-level interlinear developing solution, and a transpositional conforming device, all shown before and after the game is played, respectively.

FIG. 20A shows a cryptographic guessing game 216 based on a purely transpositional cipher. The ciphertext 218 is the same message used for FIG. 1A, but enciphered with the actions PR, WR, and WB, in that order. The cipher characters 219 are not substitutes, but are "misplaced" plain characters. Every designated place for a plain character is identified by a unique position identifier 221, in this example, a number. The developing solution 222 has horizontal lines defining a first level 224 for decoding the first action, a second level 225 for the second action, and a third level 226 for the last action and the solution, in plaintext. To make puzzle-wide rotates easier to execute, words are separated by vertical lines 227 rather than spaces, but this is optional.

The transpositional conforming device 234 is a circuitous course device with single lines defining both primary and traversal paths. It is utilized to match the positions of transpositional cipher-pairs rather than substitution cipher-pairs. Care must be taken to make the courses extra circuitous so the actions are not revealed through easily-spotted signatures of the actions. If necessary, any other kind of device can be utilized to match transpositional cipher-pairs.

Transpositional clues are sometimes not very different from substitutional clues. For example, the one-letter word can still be assumed to be a plain "T" or a plain "A", both of which cipher characters are nearby. A conforming device reference can ascertain which it is and thereby generate a new clue: A piece of evidence regarding the general left/right drift of the transpositions.

Figure 20B:
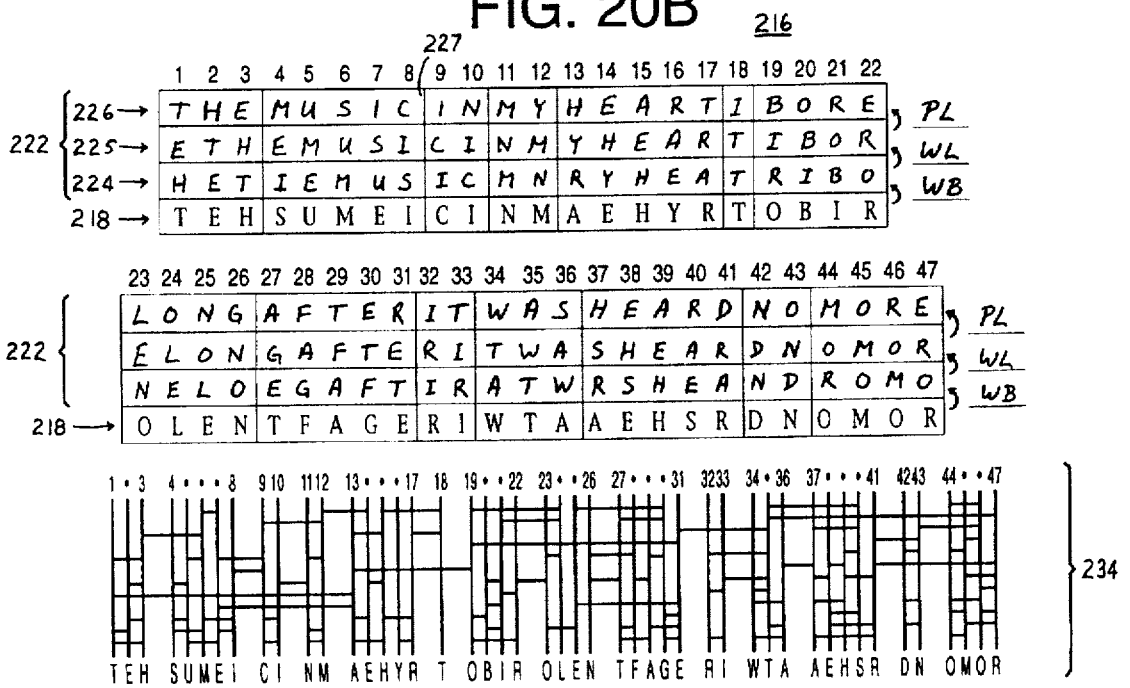
Figure 22:
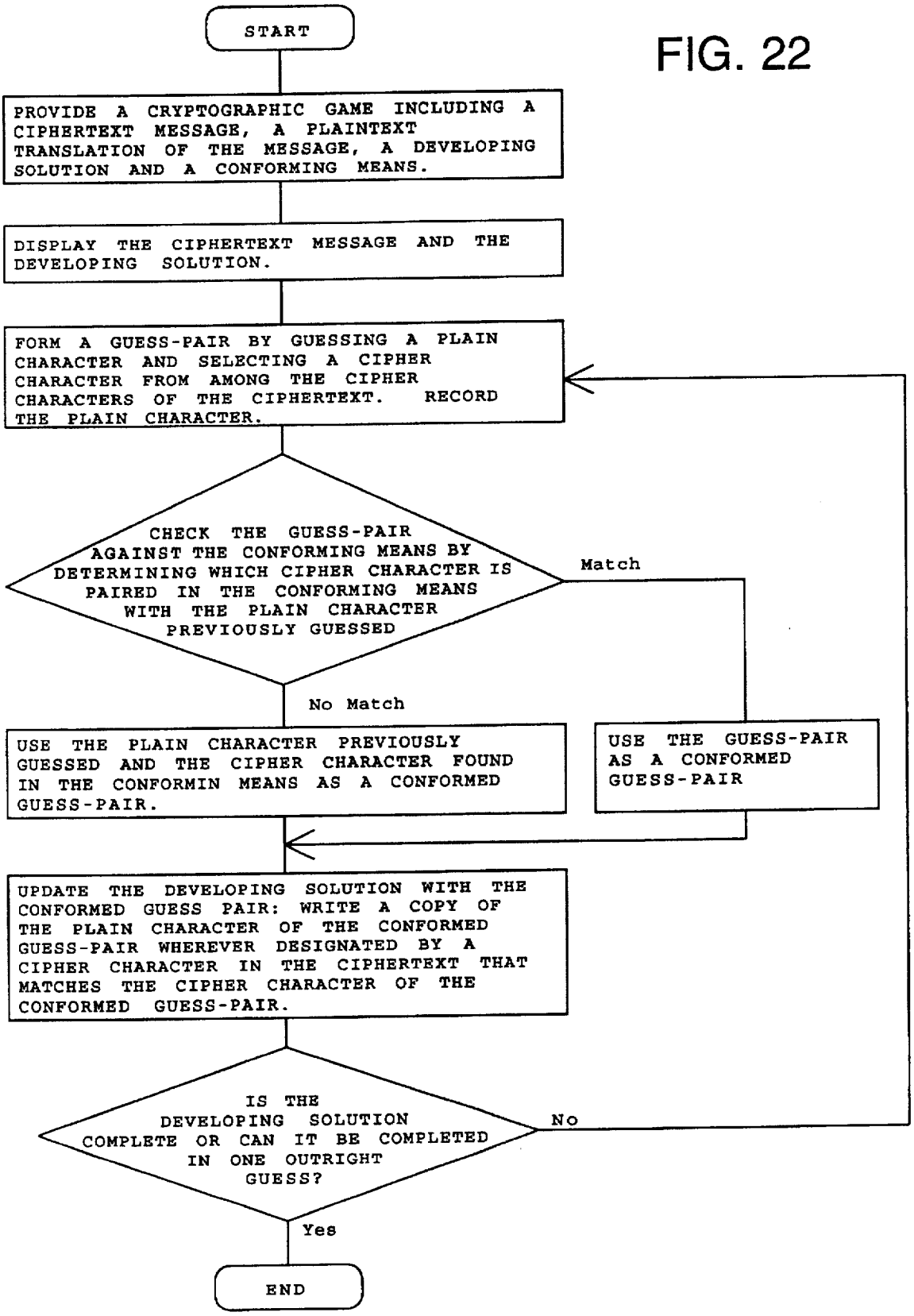
FIG. 22 is a flow chart depicting the method of play for one puzzle solver using, for example, the puzzle apparatus of FIGS. 1A–1D.
Figure 23:
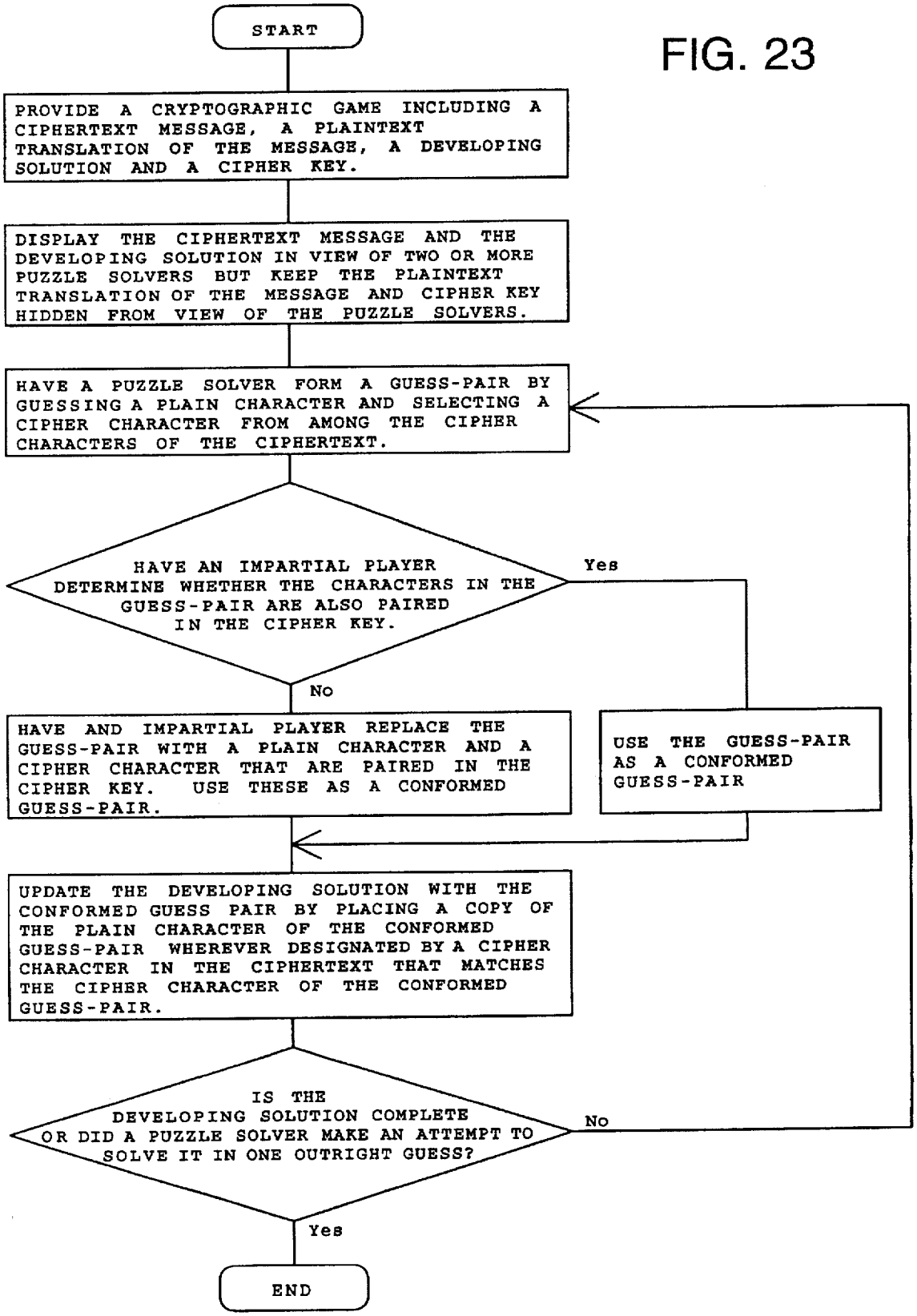
FIG. 23 is a flow chart depicting the method of play for two or more puzzle solvers and an impartial player.
Figure 24:
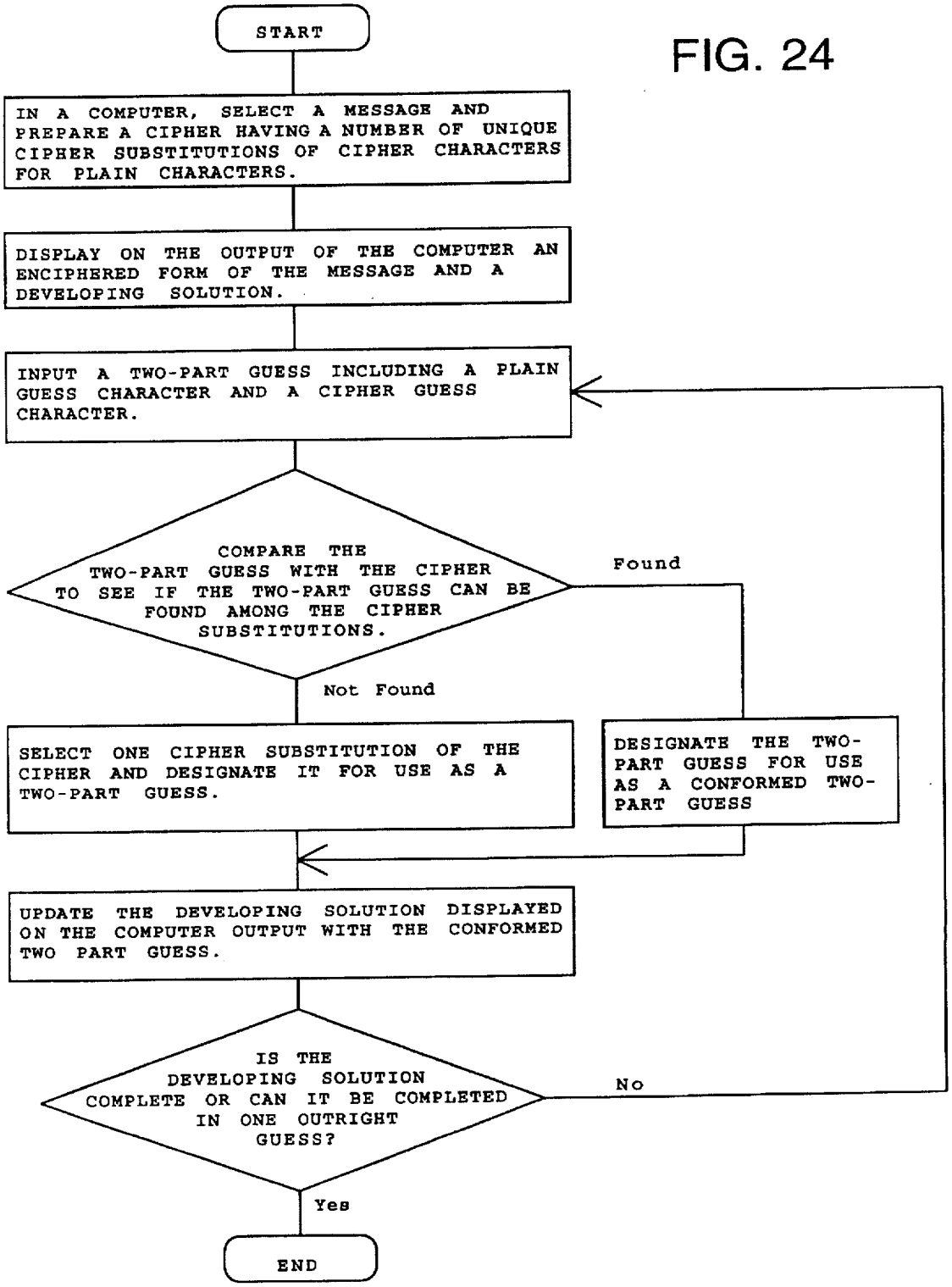
FIG. 24 is a flow chart depicting the method of play for a computer interactive embodiment of the invention.

FIG. 20B shows the puzzle of FIG. 20A solved. The three actions which generated the solution were WB, WL, and PL, in that order. The result of each action is shown on a successively higher level 224 of the developing solution 222.

Multi-puzzle Games

FIG. 18 shows a multi-puzzle game 250 of six puzzles. Each puzzle 252 is independently enciphered with a transient cipher. Each puzzle has a puzzle number 253. The conforming device 255 selectively reveals the verification characters 256 of six cipher alphabets 257 through the use of one selection alphabet 258. The six cipher alphabets 257 are keyed to the puzzles 252 with which they cooperate by a keying puzzle number 259. This conforming device 255 operates in a manner similar to the device 13 of FIG. 1A, except that the camouflage character serves double duty as the keying puzzle number 259. In this preferred embodiment it is advantageous that the puzzles 252 be chosen so their total difficulty rating 261 is some standard amount. Such provisions for the puzzle solver to total his or her score make it possible to view the six puzzles as one game. This increases the excitement and variation of the game, because if the puzzle solver is over par on some of the puzzles, he or she can try to make up for it by being extra careful when solving the remaining puzzles. FIG. 21B shows the game of FIG. 21A after play is finished. It also shows how the score summary line 270 is filled in to record the score. Other type of message, enciphering scheme, display means, and conforming means can also be used in multi-puzzle games.

Method of Making the Invention

While it may seem obvious how to make the foregoing cryptographic guessing games, the procedure is fiddled with buried details. To make matters worse, the fact that the ciphertext and conforming devices are intended to be incomprehensible to the casual observer also makes them very hard to proofread and otherwise keep consistent and correct. Any small error that does slip through can be very frustrating to the puzzle solver. It is for this reason that a cooperating series of computer programs is submitted as part of the invention. These programs can only be used to make the invention as claimed. Because of a computer's ability to manipulate seemingly meaningless symbols correctly, using these programs is the preferred method of making the games. But whether the games are made by computer or by hand, the most detailed description of the method of making them is contained in the microfiche appendix, in the BASIC computer language, with internal documentation in English.

In overview, the steps of making a one-puzzle game, given a particular message, are:

1. Obtain the message.
2. Generate a cipher.
3. Using the cipher, encipher the message to create the ciphertext.
4. Print or display (i.e., output) the puzzle, which is the ciphertext and the developing solution.
5. Using the cipher, print a conforming device or act as an interactive conforming device during solving.

Optional steps include:

6. Analyze the message's difficulty in light of the method of encipherment.
7. Select and group analyzed messages to form multi-puzzle games of uniform difficulty.

No order or sequence is specified by the step numbers. The steps may be carried out in any logically possible sequence. The BASIC-language programs and documentation in the microfiche appendix teach the best mode contemplated so far for implementing these steps.

It is important to note that the various types of messages, encipherment schemes, display means, and conforming means are orthogonal to each other in four dimensions. That is, most types of messages can be enciphered according to most encipherment schemes, the resulting ciphertext can be used with most types of developing means, and most combinations of these elements can be made to cooperate with a variety of conforming means. Nevertheless, certain types of elements and combinations of elements are more preferred than others for a given purpose and condition of play, and other types of elements and combinations of elements are more preferred for different purposes and conditions of play. Some combinations of elements may not be compatible at all.

One of the best ways of providing the invention is to provide a number of puzzles using a variety of messages, encipherment schemes, developing solutions and conforming devices. This allows the puzzle solver to enjoy many aspects of the invention and not just one. Though the invention has many forms, all of these forms are held together by the common theme, as is apparent from the specification. In addition to the ways previously disclosed, these puzzles may be provided in the form of computer software on computer readable media such as a floppy disks CD-ROM or the like.

The foregoing description of the preferred embodiments of the invention has been presented for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claims appended hereto.

I claim:

1. A computer-readable memory storage medium comprising:

a substrate from which a computer can read program codes and data, said substrate containing a computer program comprising:

means for directing the computer to obtain a message, to generate a cipher, and to create a ciphertext message by enciphering said message according to said cipher, said cipher including a plurality of pairing relationships between plaintext characters and ciphertext characters, each pairing relationship of said plurality of pairing relationships including a cipher character and a plain character paired together;

means for directing the computer to display said ciphertext message and a developing solution corresponding with said ciphertext message, said ciphertext message when displayed including a plurality of displayed cipher characters;

means for directing the computer to input a guess-pair, said guess-pair including a plain guess character and a cipher guess character;

means for directing the computer to compare said guess-pair to said cipher to determine whether said guess-pair equals any of said plurality of pairing relationships;

means for directing the computer, in the event a guess-pair to pairing relationship match was found, to update said developing solution according to said guess-pair by displaying said plain guess character of said guess-pair at every designated place corresponding to one of said displayed cipher characters which equals said cipher guess character;

means for directing the computer, in the event a guess-pair to pairing relationship match was not found, to select one of said pairing relationships of said cipher and to update said developing solution according to the selected pairing relationship by displaying the plain character of said selected pairing relationship at every designated place corresponding to one of said displayed cipher characters which equals the cipher character of said selected pairing relationship; and means for directing the computer, after updating said developing solution, to at least once return to said input step.

2. The computer-readable memory storage medium of claim 1, wherein said means for selecting one of said pairing relationships includes means for directing the computer to select the pairing relationship in which the plain character of the pairing relationship equals the plain guess character.

3. The computer-readable memory storage medium of claim 1, wherein said means for selecting one of said pairing relationships includes means for directing the computer to select the pairing relationship in which the cipher character of the pairing relationship equals the cipher guess character.

4. The computer-readable memory storage medium of claim 1 wherein said means for selecting one of said pairing relationships includes means for prompting for and inputting a selection between directing the computer to select the pairing relationship in which the plain character of the pairing relationship equals the plain guess character and directing the computer to select the pairing relationship in which the cipher character of the pairing relationship equals the cipher guess character, and further includes means for directing the computer to carrying out the selection that was inputted.

5. The computer-readable memory storage medium of claim 1 further comprising means for directing the computer to keep score and to double said score upon each occurrence of a guess-pair to pairing relationship match.

6. The computer-readable memory storage medium of claim 1 further comprising means for directing the computer to input a guess-pair from a plurality of players in turn, and to keep a separate score for each player of said plurality of players and to double the separate score of a particular player upon each occurrence of a guess-pair to pairing relationship match involving a guess-pair that was input from that particular player.

7. The computer-readable memory storage medium of claim 1 further comprising means for directing the computer to play an audio prompt prior to directing the computer to input a guess-pair and to play an audio message explaining the computer's actions when directing the computer to update said developing solution.

8. The computer-readable memory storage medium of claim 1 further comprising means for directing the computer to accept as input an outright guess and means for directing the computer to compare said outright guess to said message.

9. A method of playing a cryptographic guessing game by a plurality of puzzle solvers and at least one impartial player who is not a puzzle solver, said method comprising the steps of:

(a) providing a cryptographic game including a ciphertext message and a plaintext translation of said ciphertext message and a developing solution and a cipher key, the ciphertext message including a plurality of alphanumeric and/or symbolic cipher characters arranged in at least one row, the plaintext translation including a plurality of alphabetic plain characters, the cipher key including copies of the alphabetic plain characters of the plaintext translation of the message and copies of the cipher characters of the ciphertext message and pairing means for establishing a plurality of pairing relationships that uniquely pair each copy of an alphabetic plain character with a copy of a cipher character, and the developing solution including a plurality of positions arranged in at least one row in one-to-one correspondence with the plurality of cipher characters, each of said cipher characters representing a corresponding one of the characters of the plaintext translation of the message, and each of said positions capable of change by having an alphabetic character displayed thereon, and displaying the ciphertext message and the developing solution in view of the puzzle solvers but keeping the plaintext translation of the message and the cipher key hidden from view of the puzzle solvers;

(b) a puzzle solver guessing a plain character;

(c) a puzzle solver guessing a cipher character from among the cipher characters of the ciphertext message;

(d) the impartial player determining whether the plain character guessed in step (b) and the cipher character guessed in step (c) are paired in said cipher key;

(e) if step (d) shows the two guessed characters are not paired in said cipher key, the impartial player replacing the two guessed characters with a plain character and a cipher character that are paired in said cipher key, prior to step (f);

(f) the impartial player placing a copy of the plain character guessed in step (b) or replaced in step (e) on each of the positions designated by one to one correspondence with copies in the ciphertext of the cipher character guessed in step (c) or replaced in step (d);

(g) repeating steps (b), (c), (d), (e) and (f) at least once.

10. A method of playing a cryptographic guessing game in which puzzle solver interactively uses a computer having an input means, memory means, processing means, and output means, and a plurality of messages in said memory means, said method comprising the steps of:

(a) preparing for access by said processing means a cipher having a plurality of unique cipher substitutions, each said cipher substitution comprising a plain character and a cipher character;

(b) selecting one of said messages in said memory means;

(c) displaying on said output means of said computer a plurality of cipher characters and a developing solution, said plurality of cipher characters representing the selected message as enciphered according to said cipher substitutions and said developing solution including a plurality of positions in one to one correspondence with said plurality of cipher characters, each of said positions capable of displaying a plain alphabetic character that is represented by the cipher character to which the position corresponds;

(d) inputting via said input means a two part guess comprising a plain guess character and a cipher guess character;

(e) comparing said two part guess of step (d) with said plurality of cipher substitutions to determine whether said two-part guess is found among said cipher substitutions;

(f) if said two part guess was found among said cipher substitutions in step (e), designating said two part guess for use as a conformed two part guess in step (h);

(g) if said two part guess was not found among said cipher substitutions in step (e), selecting one cipher substitution of said plurality of cipher substitutions in said memory and designating the selected cipher substitution for use as a conformed two part guess in step (h);

(h) updating said developing solution on said output means with the conformed two part guess designated in steps (f) through (g);

(i) repeating steps (d), (e), (f), (g) and (h) at least once.

* * * * *